US011199306B2

(12) United States Patent
Bremerich

(10) Patent No.: US 11,199,306 B2
(45) Date of Patent: Dec. 14, 2021

(54) LAMP

(71) Applicant: ERCO GmbH, Luedenscheid (DE)

(72) Inventor: Matthias Bremerich, Lennestadt (DE)

(73) Assignee: ERCO GMBH, Luedenscheid (DE)

( * ) Notice: Subject to any disclaimer, the term of this patent is extended or adjusted under 35 U.S.C. 154(b) by 0 days.

(21) Appl. No.: 15/996,666

(22) Filed: Jun. 4, 2018

(65) Prior Publication Data

US 2019/0041028 A1 Feb. 7, 2019

(30) Foreign Application Priority Data

Aug. 2, 2017 (DE) ..... 102017117574.1
Oct. 4, 2017 (DE) ..... 102017122956.6

(51) Int. Cl.

| | |
|---|---|
| ***F21V 5/00*** | (2018.01) |
| ***F21V 13/04*** | (2006.01) |
| *F21Y 105/10* | (2016.01) |
| *F21Y 115/10* | (2016.01) |
| *F21W 131/107* | (2006.01) |

(52) U.S. Cl.

CPC ..... *F21V 5/008* (2013.01); *F21V 5/007* (2013.01); *F21V 13/04* (2013.01); *F21W 2131/107* (2013.01); *F21Y 2105/10* (2016.08); *F21Y 2115/10* (2016.08)

(58) Field of Classification Search

CPC .. F21V 14/04–065; F21V 5/008; F21V 5/007; F21V 5/004

See application file for complete search history.

(56) References Cited

U.S. PATENT DOCUMENTS

| | | | | |
|---|---|---|---|---|
| 5,786,939 | A * | 7/1998 | Watanabe | G02B 3/005 359/621 |
| 8,246,210 | B2 | 8/2012 | Angelini | |
| 8,496,354 | B2 | 7/2013 | Jurik et al. | |
| 9,494,292 | B2 | 11/2016 | Bremerich | |
| 2004/0042085 | A1 * | 3/2004 | Hough | F21V 14/06 362/555 |

(Continued)

FOREIGN PATENT DOCUMENTS

| | | |
|---|---|---|
| CN | 102287647 A | 12/2011 |
| CN | 203927532 U | 11/2014 |

(Continued)

OTHER PUBLICATIONS

JP 2012-059575 A English machine translation (Year: 2012).*

*Primary Examiner* — Mariceli Santiago
(74) *Attorney, Agent, or Firm* — Andrew Wilford

(57) ABSTRACT

The invention relates, inter alia, to a light fixture (10) for illuminating building surfaces (17) or partial surfaces of a building, comprising a housing (11), at least one light source, in particular an LED (12, 12*a*, 12*b*, 12*c*) and at least one collimator optical unit (15, 15*a*, 15*b*, 15*c*) for focusing the light emitted by the light source. The particularity of the invention, inter alia, is that in the light path downstream of the collimator optical unit at least two lens plates (18, 19) are provided, on both of which a plurality of lens elements (22*a*, 22*b*, 22*c*, 23*a*, 23*b*, 23*c*) being arranged, in particular grouped, thereon, wherein the spacing (32) between the two lens plates is variable by an adjusting device (20), and wherein the light fixture provides different light distributions (37, 38, 39, 50*a*, 50*b*, 50*c*) in different spacings of the lens plates.

15 Claims, 17 Drawing Sheets

(56) References Cited

U.S. PATENT DOCUMENTS

Figure 1:
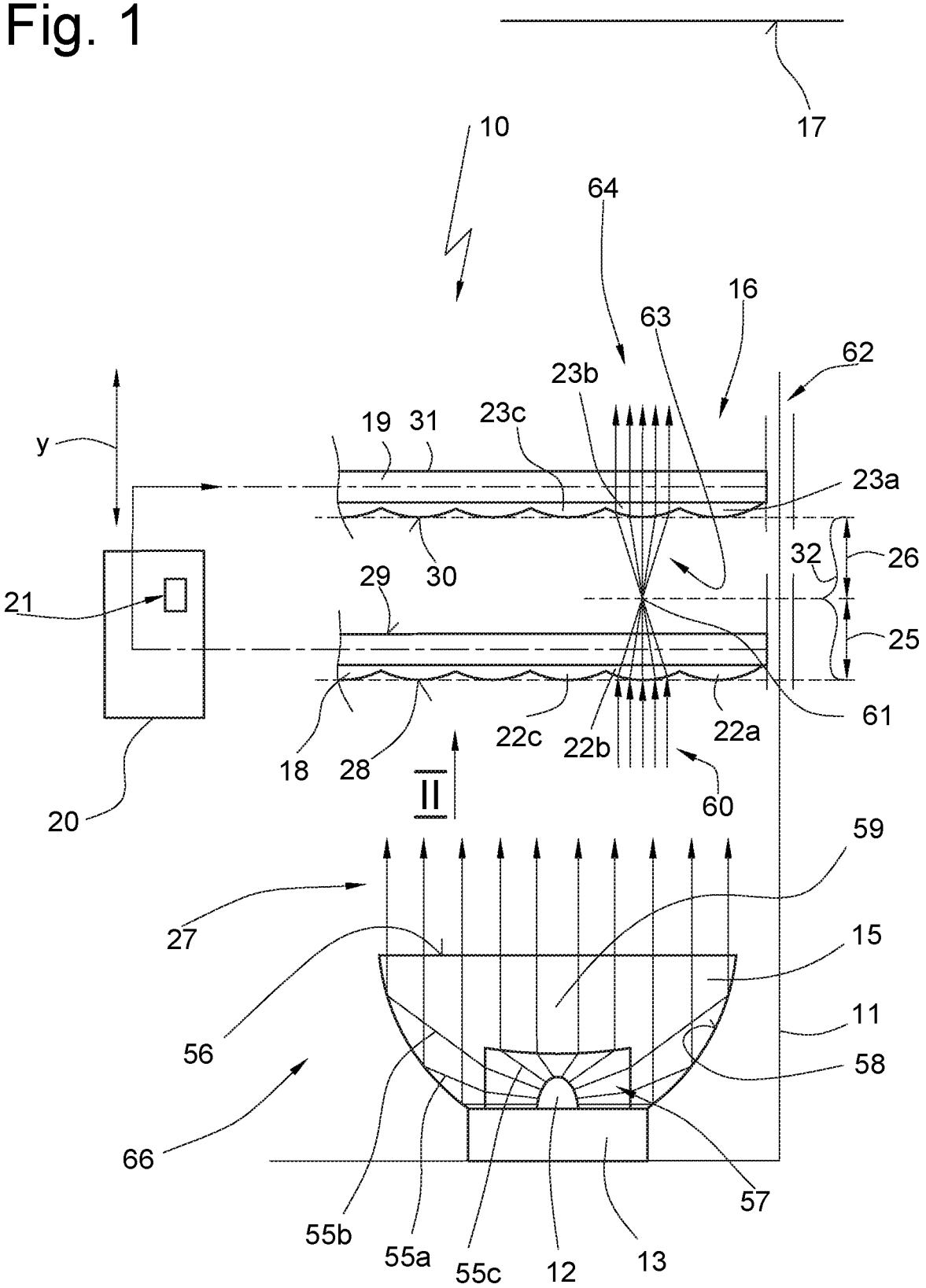

| | | | | |
|---|---|---|---|---|
| 2008/0278925 | A1 | 11/2008 | Wernersson | |
| 2010/0188018 | A1 | 7/2010 | Salm | |
| 2011/0267823 | A1 | 11/2011 | Angelini et al. | |
| 2011/0280018 | A1* | 11/2011 | Vissenberg | G02B 3/005 362/277 |
| 2012/0121244 | A1* | 5/2012 | Stavely | F21V 5/007 362/232 |
| 2012/0127710 | A1 | 5/2012 | Jurik et al. | |
| 2015/0211708 | A1* | 7/2015 | Stavely | F21V 5/007 362/231 |

FOREIGN PATENT DOCUMENTS

| | | | | | |
|---|---|---|---|---|---|
| DE | 102009060566 | A1 | | 6/2011 | |
| DE | 102009060897 | A | | 7/2011 | |
| DE | 102010008359 | A | | 8/2011 | |
| DE | 102010022477 | A | | 12/2011 | |
| DE | 102012006999 | A | | 10/2013 | |
| DE | 102013011877 | A | | 1/2015 | |
| DE | 102013021308 | A | | 6/2015 | |
| EP | 2327927 | A | | 11/2012 | |
| JP | 2012059575 | A | * | 3/2012 | F21V 5/008 |
| JP | 2012059575 | A | | 3/2012 | |
| WO | 2012/117363 | A1 | | 9/2012 | |
| WO | 2012117363 | A | | 9/2012 | |
| WO | 2012/134406 | A1 | | 10/2012 | |
| WO | WO-2012134406 | A1 | * | 10/2012 | F21V 14/06 |

* cited by examiner

LAMP

The invention initially relates to a light fixture according to the preamble of claim 1.

Such light fixtures have been developed and produced by applicant for many years.

Light fixtures of the generic type are disclosed, for example, in the German patent applications and patents DE 10 2008 063 369 B1 [U.S. Pat. No. 9,494,292], DE 10 2010 022 477 A1, DE 10 2009 060 897 B1, DE 10 2010 008 359 A1, EP 2 327 927 B1, DE 10 2012 006 999 A1, DE 10 2013 011 877 B1 and DE 10 2013 021 308 B1 that all refer back to the Applicant.

From the light fixtures of the generic type previously disclosed in printed publications it is already known to focus the light coming from a light source, in particular from an LED, by a collimator optical unit and thus to supply light to a tertiary optical unit in the form of a lens plate. Such a lens plate is disclosed, for example, in EP 2 204 604 B1 [U.S. Pat. No. 9,494,292].

In order to alter the radiation characteristic of the light fixture, i.e. the light distribution that is able to be generated by the light fixture, it is known to use lens plates with different lens elements. Thus, by replacing a first lens plate with a second lens plate that has lens elements with different radii of curvature or other facets, for example, the radiation angle of the light fixture may be altered.

Proceeding from a light fixture of the generic type, the object of the invention is to develop a known light fixture such that the light fixture permits an alteration to its radiation characteristic in a simple manner.

The invention solves this object by the features of claim 1, in particular those of the characterising part, and accordingly the invention is characterized in that in the light path downstream of the focusing optical unit, in particular a collimator optical unit, at least two lens plates are provided, each having a plurality of lens elements, in particular grouped, thereon, wherein the spacing between the two lens plates is able to be altered by an adjusting device and wherein the light fixture provides different light distributions in different spacings of the lens plates.

The principle of the invention is to provide two lens plates. The lens plates are arranged in series one behind the other. The light radiated by the focusing optical unit initially passes through the first lens plate and then the second lens plate. Each of the two lens plates has a plurality of lens elements. The lens elements are, in particular, grouped and, in particular, arranged in groups according to a predetermined pattern or according to a predetermined structure.

According to the principle of the invention the light fixture has at least one focusing optical unit. A device that is able to focus the light emitted by the light source is understood as a focusing optical unit. In this case, in particular, it may be a collimator optical unit, i.e. a lens element that carries out the focusing. Alternatively, the focusing optical unit may also be provided by a reflector element.

It is significant that the parallel or substantially parallel light or approximately parallel light is emitted by the light source and the focusing optical unit, which together are also denoted as the light drive.

Insofar as within the course of this patent application the invention is described with reference to a collimator optical unit, this is intended to be understood merely as an example of focusing optical units in general.

The light fixture according to the invention also comprises an adjusting device. by the adjusting device the spacing between the two lens plates may be altered. In a first variant, the adjusting device may displace the first lens plate relative to the second lens plate that is fixed on the housing or alternatively the adjusting device may displace the second lens plate relative to the first lens plate that is fixed relative to the housing. According to a further variant, both lens plates are able to be displaced relative to the housing and are displaced relative to one another by the adjusting device by altering the spacing thereof.

The principle further consists in that the light fixture provides light distributions that are different from one another at different spacings of the lens plates. Thus in a first spacing position of the two lens plates the light fixture may provide a first radiation characteristic, for example a narrow light radiation, for example a spotlight radiation characteristic, and in a second different spacing position of the lens plates from one another the light fixture may provide a second light distribution, for example a greater radiation angle, in particular a floodlight-light distribution or wide floodlight-light distribution.

Any light fixtures that serve as ground, wall or ceiling light fixtures of a building, optionally as spotlights or fitted light fixtures, for the illumination of a building surface or partial surfaces of a building, are regarded as a light fixture for illuminating building surfaces. Light fixtures that are able to illuminate the surfaces of an external region of a building, i.e. for example car park areas, open spaces or walkways are also understood thereby. "Building surfaces to be illuminated" within the meaning of claim 1 are also understood as paintings or works of art to be illuminated.

The light fixture may be configured, for example, as spotlights and, for example, may be arranged so as to be able to be altered in position and so as to be able to be fixed on the ceiling side in a building space or on the floor side, even in an external space. However, the light fixture may also be configured, for example, as a downlighter and illuminate floor regions or wall regions of the building space.

The light fixture has a housing, at least the light source being accommodated therein. In particular, the light fixture naturally also optionally has components, such as for example a socket for the light source, for example a printed circuit board in the case of a light source configured as an LED, and electronic control elements or other electronic components. The light fixture may also have a voltage supply. The light fixture may be provided with an integrated or external control device that is arranged in a separate housing or in the same housing.

Preferably, one or more LEDS are provided as the light source. Alternatively, other light sources, such as for example lasers, are also considered. Preferably, punctiform or approximately punctiform light sources are used.

Also so-called COB LEDs (i.e. Chip on Board LEDs) are considered as the light source. These COB LEDs, for example together with a reflector, may also provide a focusing optical unit within the meaning of the invention.

The light source forms a unit together with the collimator optical unit. The collimator optical unit serves for focusing the light emitted by the light source, in particular by the LED. In the case of the use of an LED as a light source, the collimator optical unit may be a conventional collimator optical unit as is disclosed in the protective rights of the Applicant described in the introduction, the contents thereof therefore being included in the disclosure of this patent application.

Within the scope of this patent application, the light source together with the focusing optical unit, in particular the collimator optical unit, is also denoted as a light drive. The light drive serves, in particular, to project parallel light or substantially parallel light onto the entry side of a first lens plate. The lens plates are both configured to be transparent or translucent and consist, for example, of a clear plastics material or of glass. Preferably, the lens plates each are provided from plastics material, for example PMMA, or acrylic glass or a comparable plastics material and may be formed, in particular, from an injection-moulded part.

The two lens plates may be configured identically or substantially identically. In a variant of the invention the two lens plates are configured differently.

The light emitted by the collimator optical unit enters the entry surface of the first lens plate and emerges from the exit side of the first lens plate. From there it is directed toward the entry side of the second lens plate and emerges through the exit surface of the second lens plate.

In the light path downstream the second lens plate the light fixture may also have a protective glass. However, light fixtures are encompassed by the invention, in particular, in which no further optical elements are arranged in the light path downstream of the second lens plate. Naturally, light fixtures are also encompassed by the invention in which a further diffuser film or comparable elements are arranged in the light path downstream of the second lens plate.

According to the invention, an adjusting device is provided. by the adjusting device the spacing between the two lens plates may be altered. The adjusting device may be driven by motor or alter the spacing between the two lens plates as a result of a manual actuation. The adjustment path may, for example, be a few millimetres. The lens plates are able to be adjusted at least between a first spacing position and a second spacing position. In a first spacing position of the two lens plates, the light fixture generates a first light distribution and in a second, different spacing position of the two lens plates the light fixture generates a second distribution that is different from the first. The two different light distributions may, for example, encompass different radiation angles of the light fixture.

In a variant of the invention, the spacing between the two lens plates is able to be continuously altered and, further preferably, in a substantially stepless manner. In an alternative embodiment of the invention, the spacing between the two lens plates may be altered in discrete steps, i.e. for example in a stepwise manner.

Each of the numerous lens elements is arranged on the two lens plates. The lens elements may, for example, be provided by facets arched in a spherical or aspherical manner. In a variant of the invention, each lens element on the first lens plate is provided with a lens element on the second lens plate. In this variant, the light that is incident on the lens element of the first lens plate from the collimator optical unit is exclusively oriented toward an opposing lens element on the second lens plate. According to a variant of the invention, this clear assignment of two lens elements on the different lens plates is maintained even in different spacings.

Due to the fact that the collimator optical unit radiates parallel light or substantially parallel light onto the first lens plate, the individual beam bundles are comparable:

A lens element on the second lens plate is fixed so as to oppose each or approximately each lens element on the first lens plate. Corresponding pairs of opposing lens elements each exhibit the same optical behaviour in different spacings of the lens plates.

The fixed assignment of the lens elements of the first lens plate to the lens elements of the second lens plate is guaranteed by the rotational position of the two lens plates not being altered relative to one another during the alteration of the spacing. This may be ensured by a positioning device.

The lens elements according to the invention may be arranged on one respective side or even on both respective sides of the lens plates.

If the lens elements are arranged on only one side of the lens plate, these elements may be arranged facing one another or facing away from one another.

It is further encompassed by the invention if the lens elements of a lens plate are all configured identically or are configured to be similar to one another. However, it is also encompassed by the invention if the lens plates carry different lens elements or a plurality of groups of different lens elements, wherein the lens elements of one group are configured identically.

The lens elements of a lens plate, for example, may have an identical radius so that all of the lens elements of a lens plate have an identical focal length.

The lens elements of the respective other lens plate may have the same radius or a different radius. In a variant of the invention, the focal length of the lens elements or lens plate that is adjacent to the collimator optical unit is greater than the focal length of the lens elements of the lens plate that is arranged remotely from the collimator optical unit.

The individual lens elements may, for example, be provided by spherical or aspherical arched structures, for example also by paraboloids of revolution. The individual lens elements may be described approximately by a spherical shape and/or by a radius.

According to an advantageous embodiment of the invention, the adjusting device has a motorized drive, in particular an electromotive drive. The adjusting device is, for example, provided with an electric motor that may ensure direct displacement of one of the two lens plates relative to the other lens plate. The drive may cooperate with a control unit that may receive control commands. To this end, for example, it may be provided that an actuating device is provided directly on the light fixture, in particular in the housing of the light fixture or on a housing of the control device or immediately adjacent the light fixture, said actuating device permitting a user to input control commands directly or indirectly for altering the light radiation characteristic of the light fixture. Alternatively, the drive may also be operated by a central light fixture control system, for example by a command centre, for example by a light control centre, arranged remotely or at a distance from the light fixture.

According to a further advantageous embodiment of the invention, the adjusting device has a manually actuatable adjusting element. In this case, an alteration to the spacing between the two lens plates may be ensured, for example, by a manual actuation, for example by a rotary switch, a knob, a rotatable adjusting ring or a different adjusting element or adjusting member.

According to a further advantageous embodiment of the invention, the adjusting device is provided with a positioning device that ensures that the relative rotational position between the two lens plates is maintained when carrying out an alteration to the spacing between the two lens plates. In this case, the relative rotational position of the one lens plate relative to the other lens plate is maintained during the alteration to the spacing. This may ensure, for example, an anti-rotation locking device that has, for example, guide rods or corresponding receivers or the like.

Axial bearings may also ensure the desired axial movement of the two lens plates relative to one another without carrying out a rotational movement.

According to a further advantageous embodiment of the invention, the different light distributions comprise different radiation angles of the light fixture. For example, it may be provided that the light fixture generates a light distribution that is substantially rotationally symmetrical, wherein a first radiation angle is provided of, for example, 8° or 10° and a second radiation angle is provided of, for example, 60° or 90°. Any number of continuously altered radiation angles corresponding to different spacings of the two lens plates to one another may be achieved therebetween.

According to an advantageous embodiment of the invention, the different radiation angles may encompass, for example, light distributions between spotlights and wide floodlights.

An alteration to the light distribution according to the invention, for example, may comprise an alteration to the radiation angle from a spotlight characteristic to a floodlight characteristic or from a floodlight characteristic to a wide floodlight characteristic or from a spotlight characteristic via a floodlight characteristic to a wide floodlight characteristic. According to the invention, a spotlight characteristic comprises, in particular, for example radiation angles of less than 30°, a floodlight-light distribution comprises, in particular, for example a radiation angle of between 30 and 45° and a wide floodlight-light distribution, in particular, has a radiation angle of between 45 and 70°.

According to an advantageous embodiment of the invention, in particular, radiation angles between a spotlight distribution of approximately 8° and a wide floodlight distribution corresponding to a radiation angle of approximately 65° are able to be altered continuously.

For the sake of clarity, reference is made to the fact that within the meaning of the present invention, in particular, the angle that in the technical sense is denoted as the opening angle and represents the so-called "full width half max" value is denoted as the radiation angle and/or as the specified angle of a light distribution. In this case, it is the value of the light radiation angle where the light intensity is less than approximately half of the maximum light intensity.

According to an advantageous embodiment of the invention, the spacing between the lens plates is able to be altered continuously. This may be ensured by an adjusting device operating in a stepless manner. With a continuous alteration of the spacing between the two lens plates a continuous alteration of the radiation characteristic of the light fixture, in particular a continuous alteration of the radiation angle, may be achieved.

According to a further advantageous embodiment of the invention, one of the two lens plates is fixed relative to the housing and the other lens plate is displaceable by the adjusting device relative to the other lens plate and/or relative to the housing.

This may result in a particularly accurate adjustment of the lens plates relative to one another being able to be ensured.

According to a further advantageous embodiment of the invention, the lens elements have facets on at least one of the two lens plates. In particular, the facets are configured to be arched. Advantageously all or approximately all of the lens elements are configured as facets. Further advantageously, all or approximately all of the facets are configured identically.

The facets may be arched in a spherical or aspherical manner. The facets may also approximate a sphere, in particular. Furthermore, the facets may be provided by a paraboloid of revolution and, for example, have a parabolic or substantially parabolic cross section.

According to a further advantageous embodiment of the invention, a lens element may have a focal length. In this case, it may be advantageously provided that each or approximately each of the lens elements have the same or approximately the same focal length.

Further advantageously, the adjustment path along which an alteration may be undertaken to the spacing between the two lens plates from one another is approximately in the order of two focal lengths. This means that the lens plates are displaceable between a first spacing position in which they are in contact with one another and a second spacing position in which they are spaced apart from one another by approximately two focal lengths.

According to a further advantageous embodiment of the invention, each lens element of a lens plate is associated with a lens element of the other lens plate. The assignment may be made, in particular, fixedly. This means that the assignment is maintained, even during an alteration to the spacing between two lens plates. In this case, it may be further advantageously provided that the light from the collimator optical unit that is incident on a specific lens element of the first lens plate is exclusively deflected toward a specific opposing lens element of the second lens plate. Further advantageously, this fixed assignment is not able to be altered along the entire adjustment path.

According to a further advantageous embodiment of the invention, the assignment is such that light components that emerge from the collimator optical unit, are incident on a lens element of the first lens plate and are directed from said first lens element only toward a lens element of the second lens plate.

According to a further advantageous embodiment of the invention, the assignment of the lens elements of the first lens element to the lens elements of the second lens element is maintained when the spacing is altered between the lens plates.

According to a further advantageous embodiment of the invention, the lens elements have lenticular facets on at least one of the two lens plates. In this case, they are axially longitudinally extended cylindrical facets that are curved along a first plane and that are not curved, or at most slightly curved, along a second plane transversely thereto.

According to a further feature the invention relates to a method according to claim 15.

The object of the invention is to specify a method by which an alteration to the radiation characteristic of a light fixture is able to be achieved in a simple manner.

The invention achieves this object by the features of claim 15.

In order to avoid repetition, reference is made to the above embodiments and observations that apply to claims 1 to 14 and that in a similar manner also relate to the invention according to claim 15.

Instead of two lens plates arranged in the light path downstream of the focusing optical unit, the principle here is to provide a plurality of lens elements directly on the collimator optical unit, in particular on the outlet side or light exit side, and to displace the second lens plate relative to the collimator optical unit by an adjusting device, for the purpose of altering the radiation characteristic of the light fixture.

Moreover, in order to describe this invention and in order to avoid repetition, reference is made to the above embodiments of light fixtures of claims 1 to 14.

Figure 2:
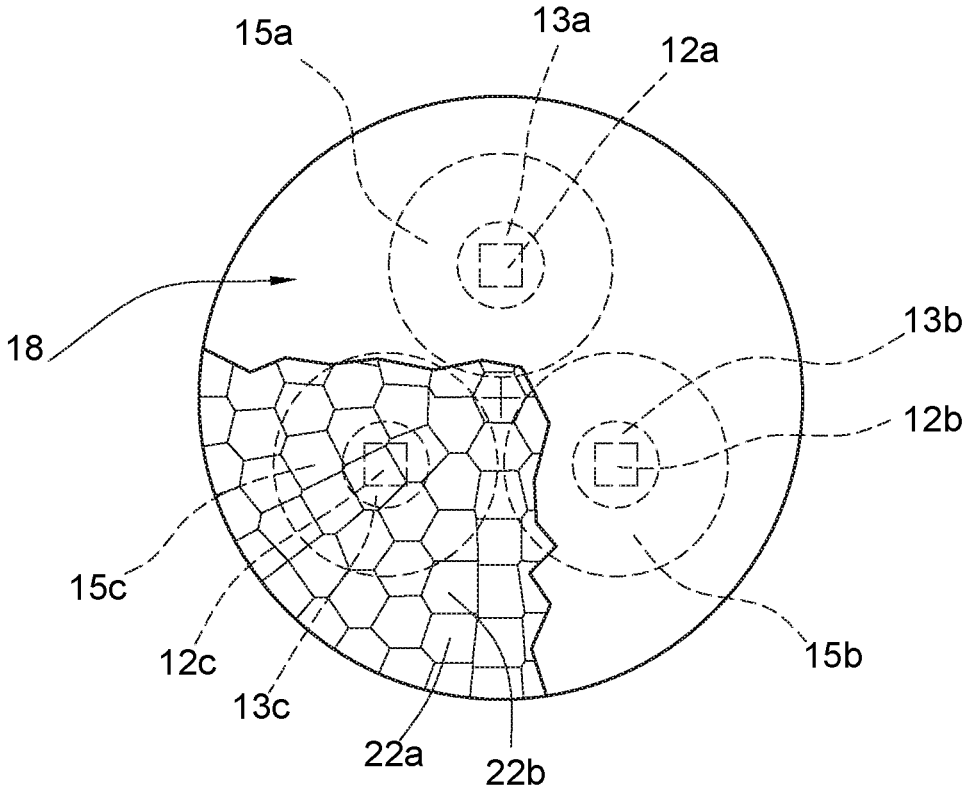
Figure 3:
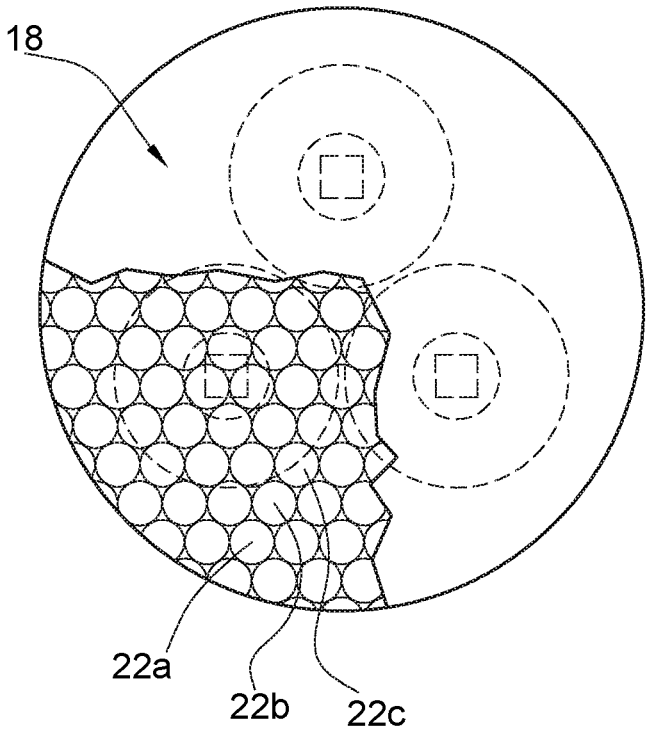
Figure 4:
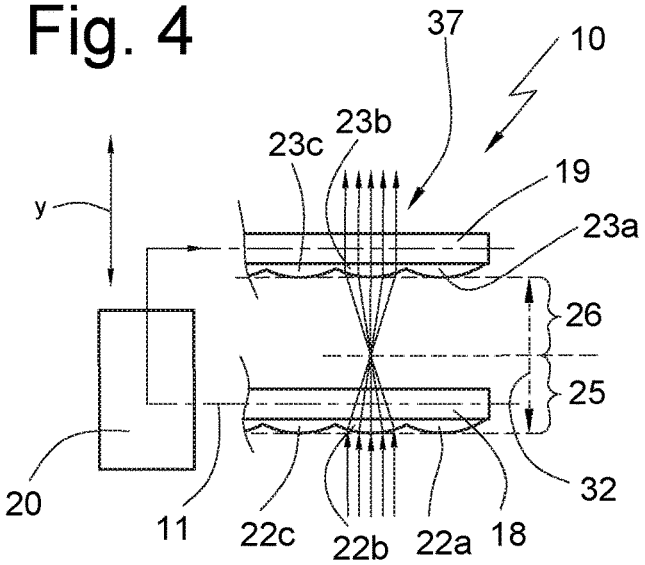
Figure 7:
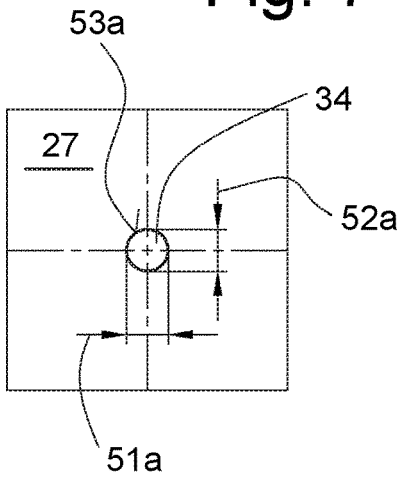
Figure 5:
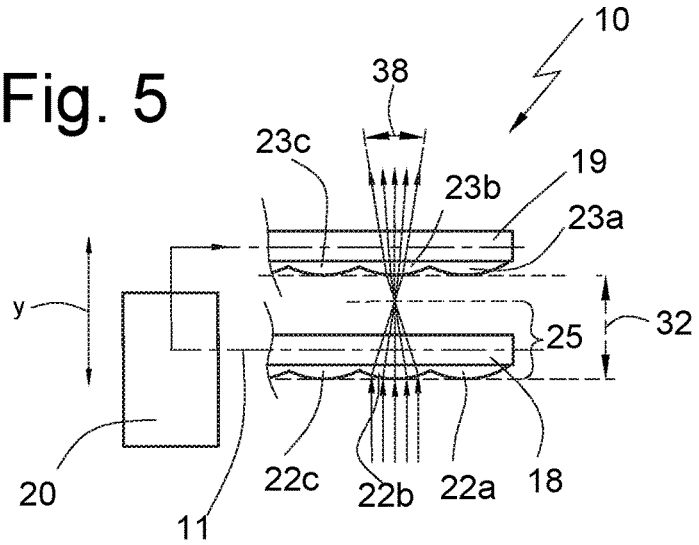
Figure 8:
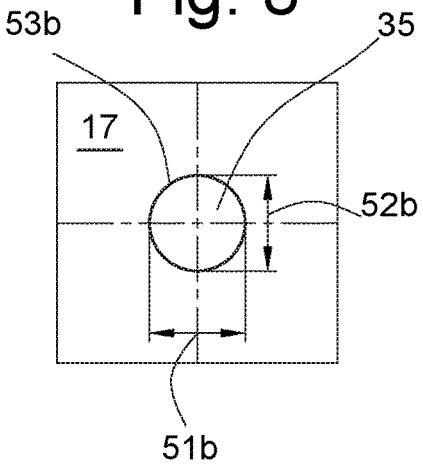
Figure 6:
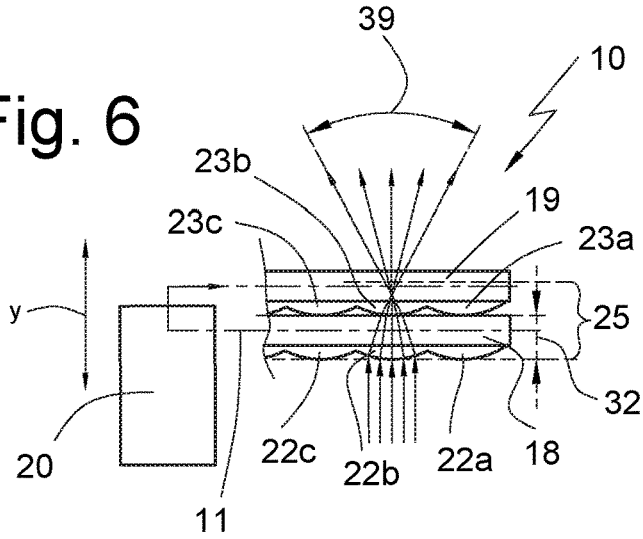
Figure 9:
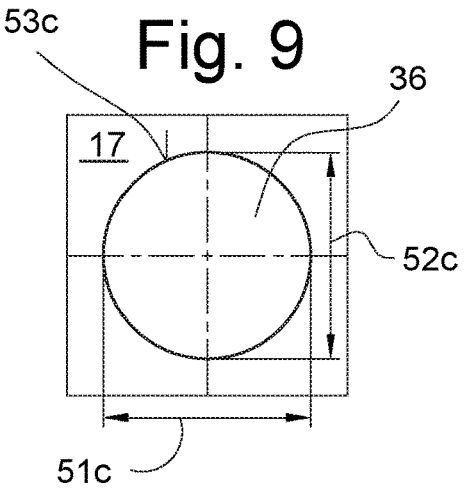
Figure 10:
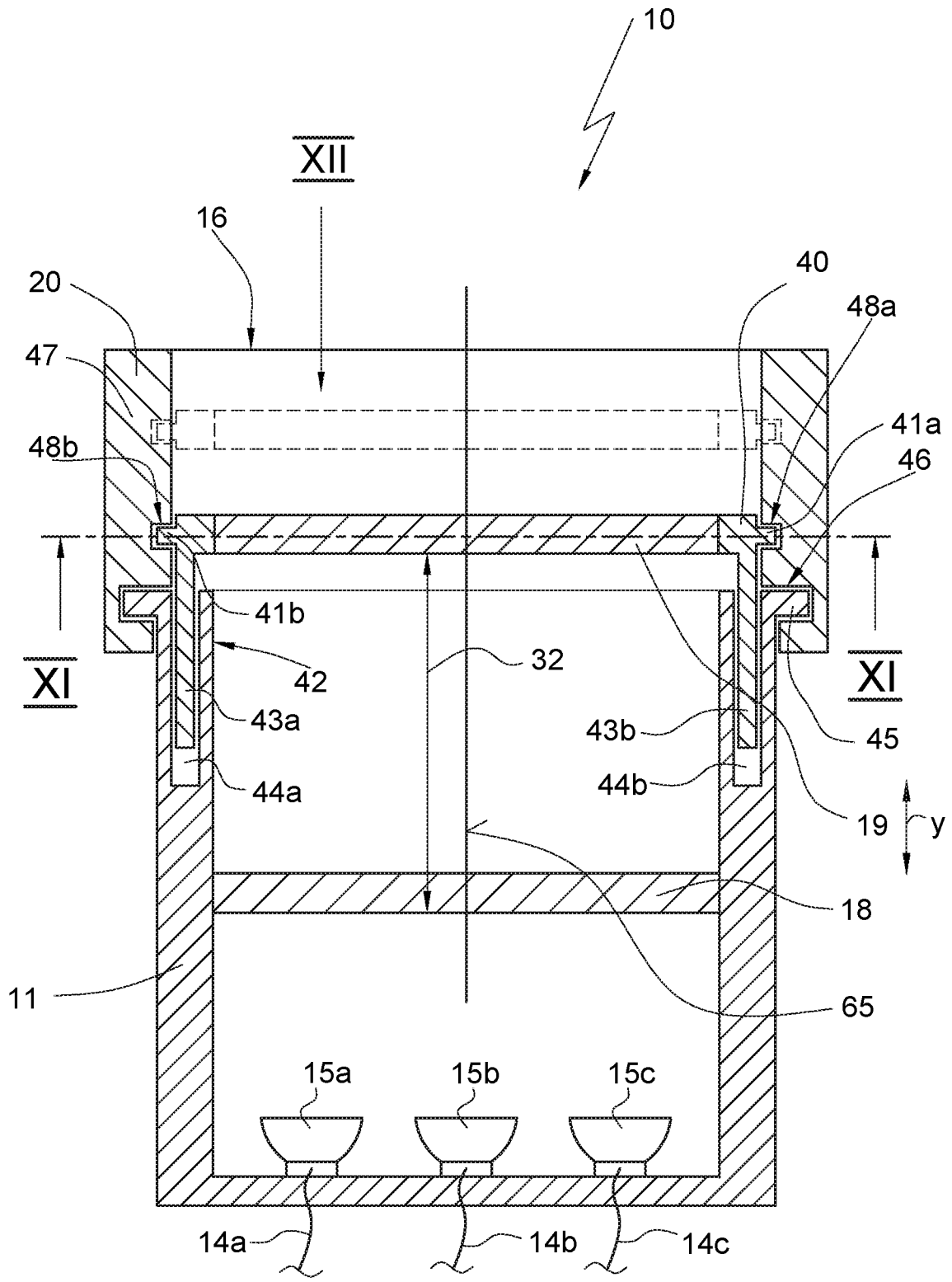
Figure 11:
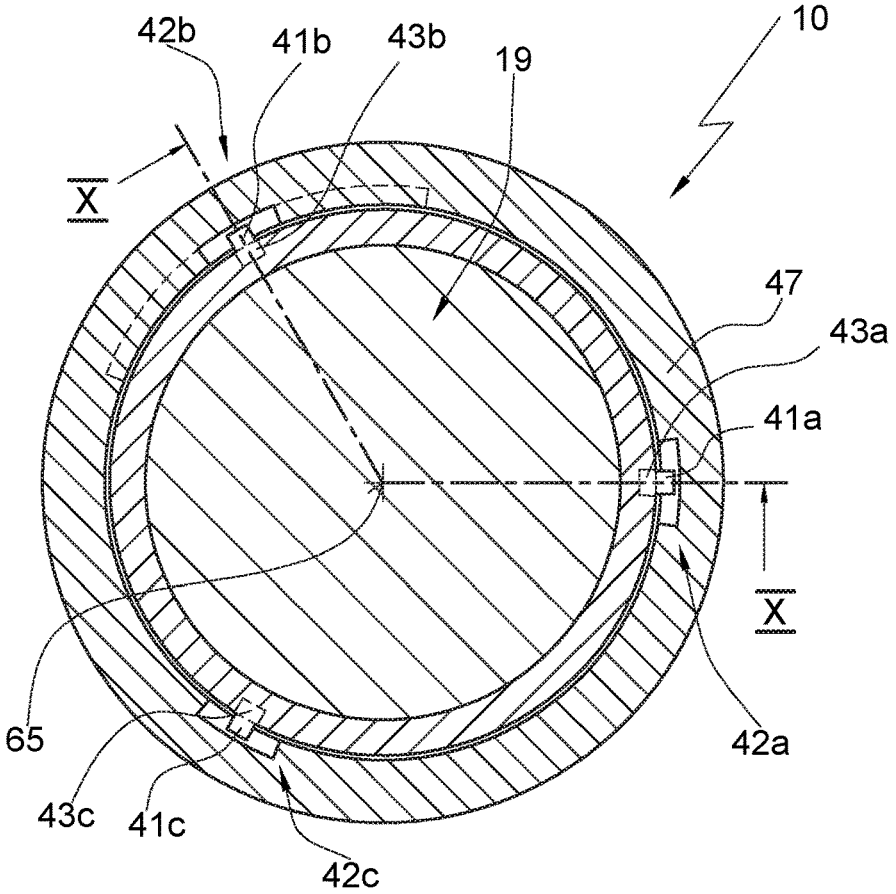
Figure 12:
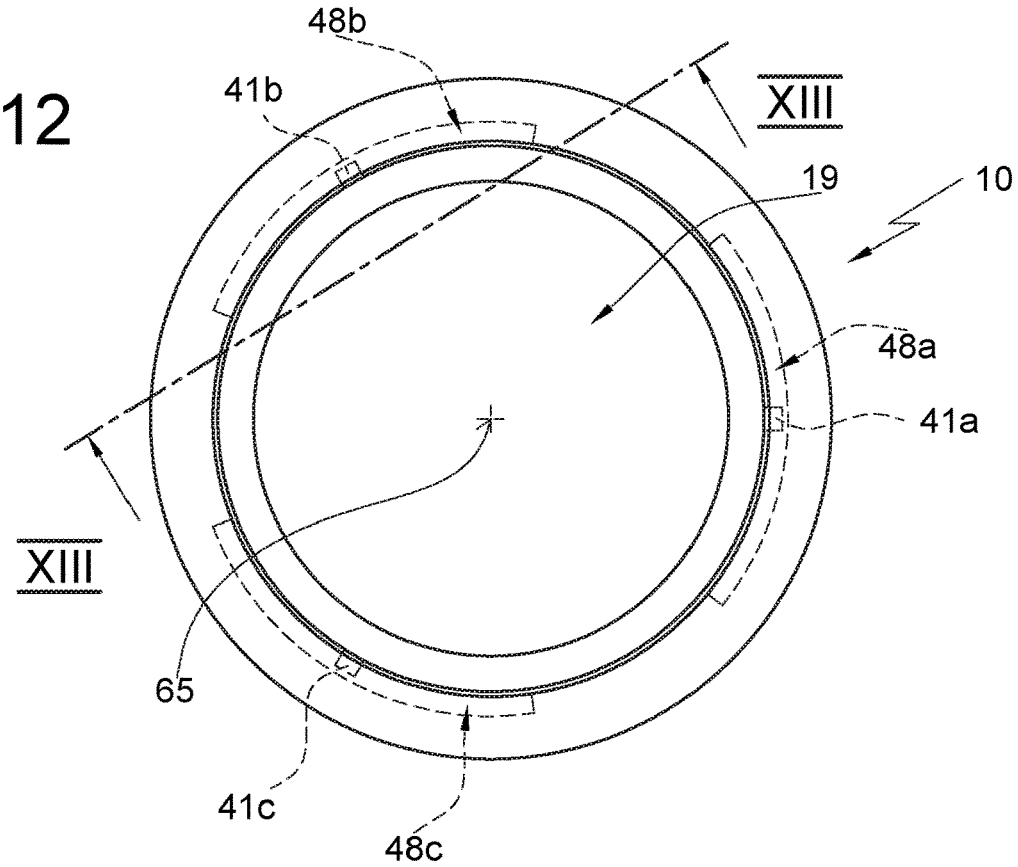
Figure 13:
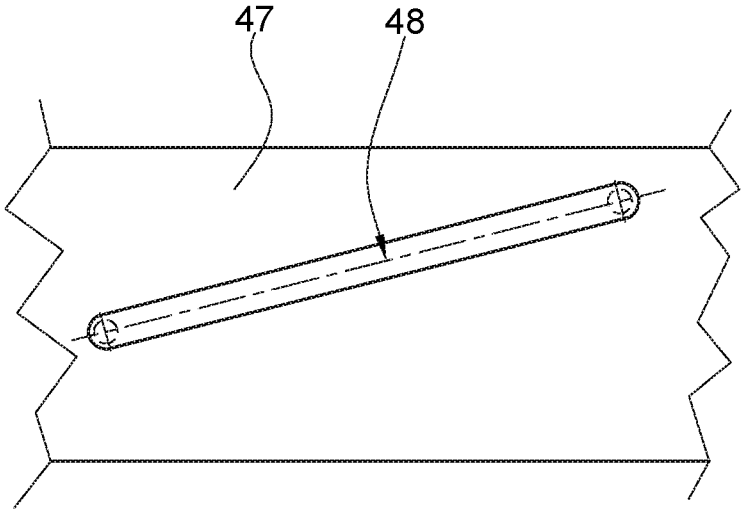
Figure 14:
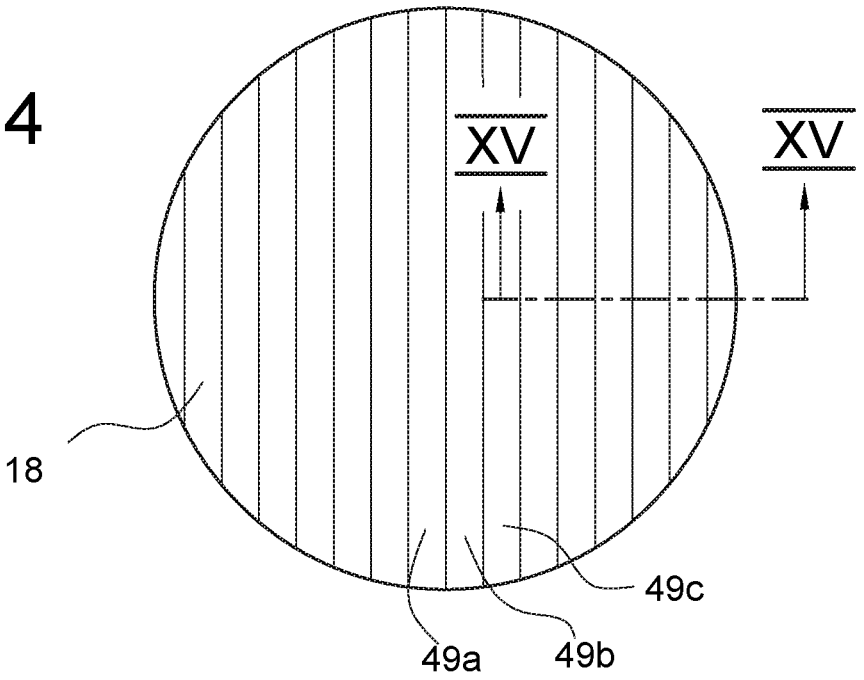
Figure 15:
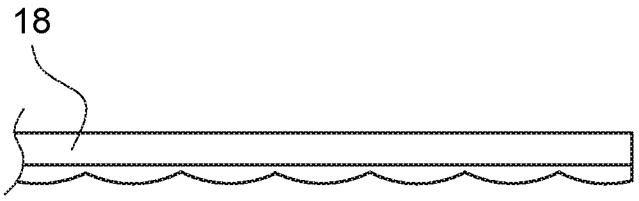
Figure 16:
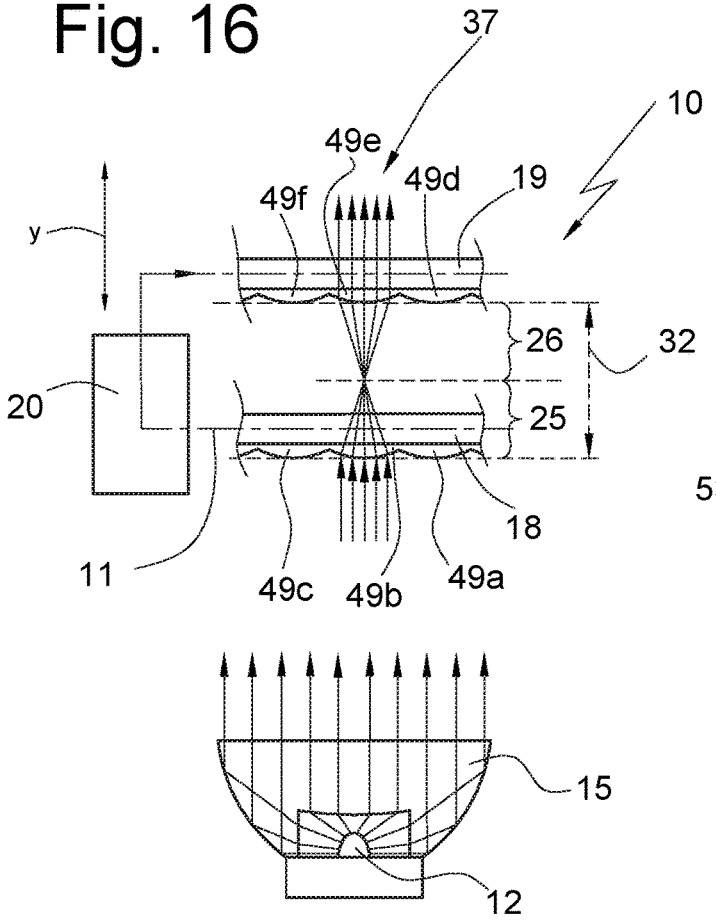
Figure 17:
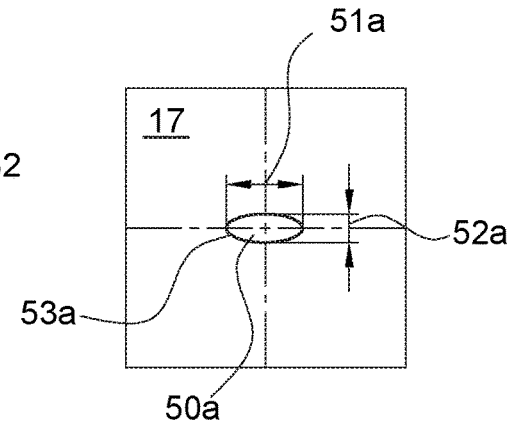
Figure 18:
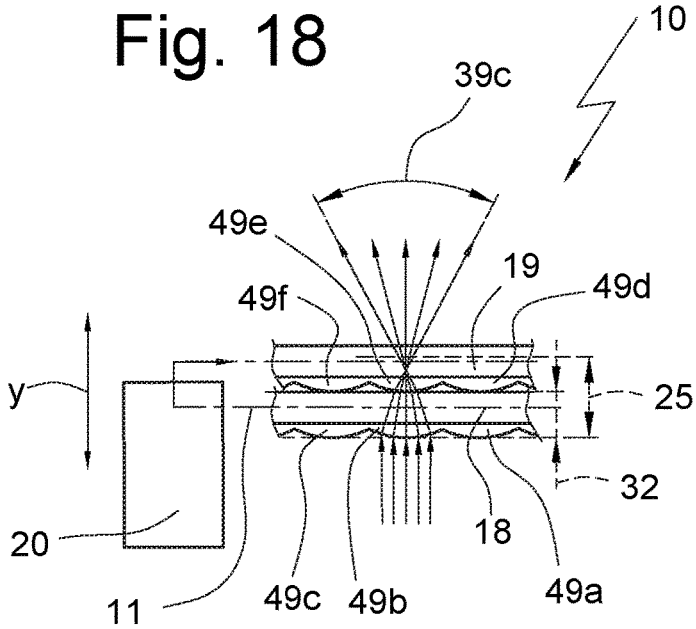
Figure 19:
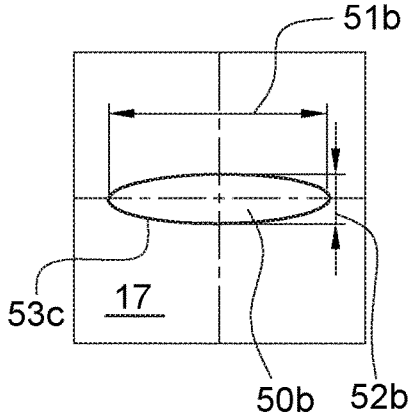
Figure 20:
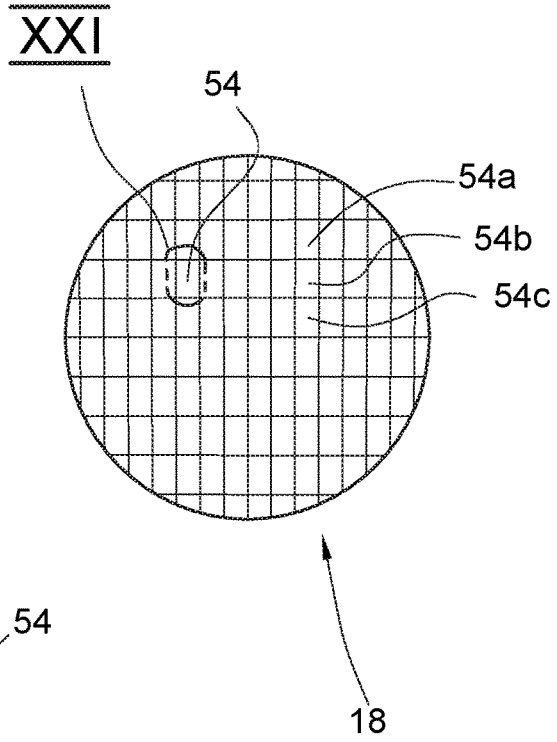
Figure 21:
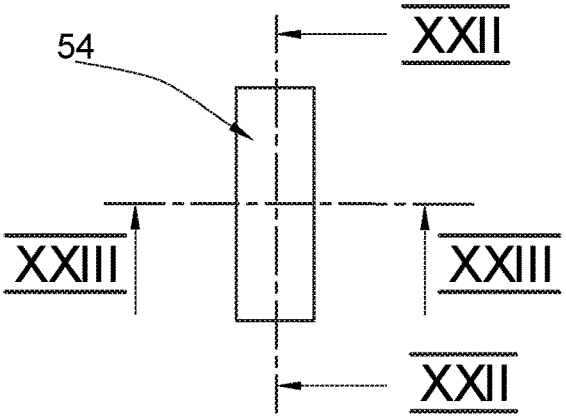
Figure 22:
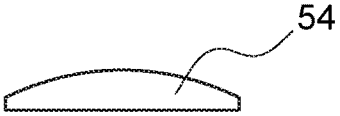
Figure 23:
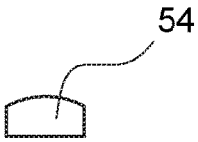
Figure 24:
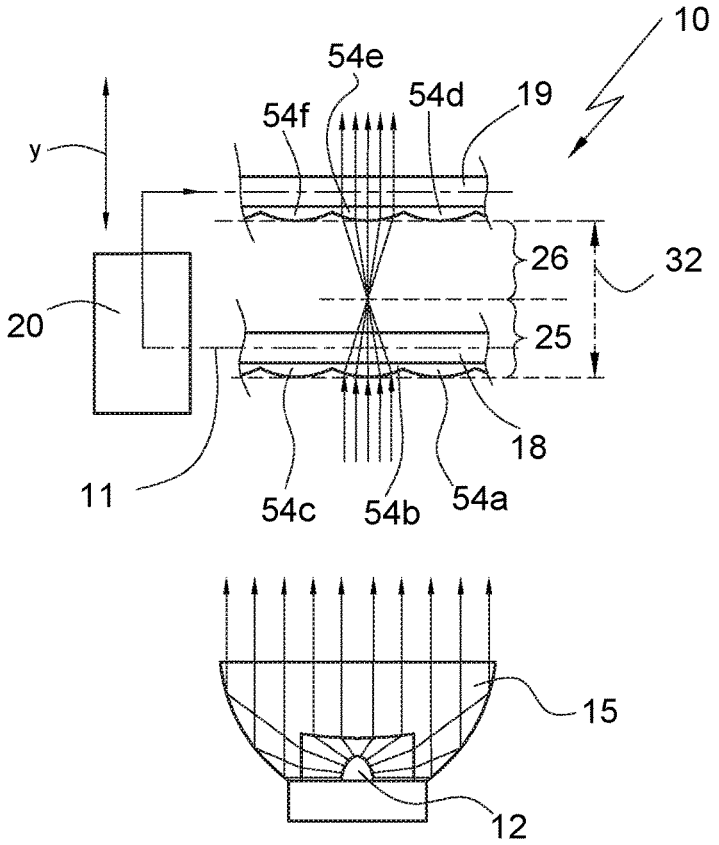
Figure 26:
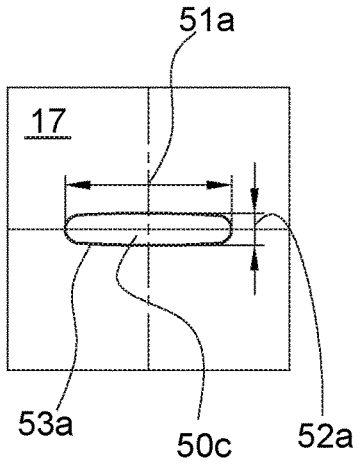
Figure 25:
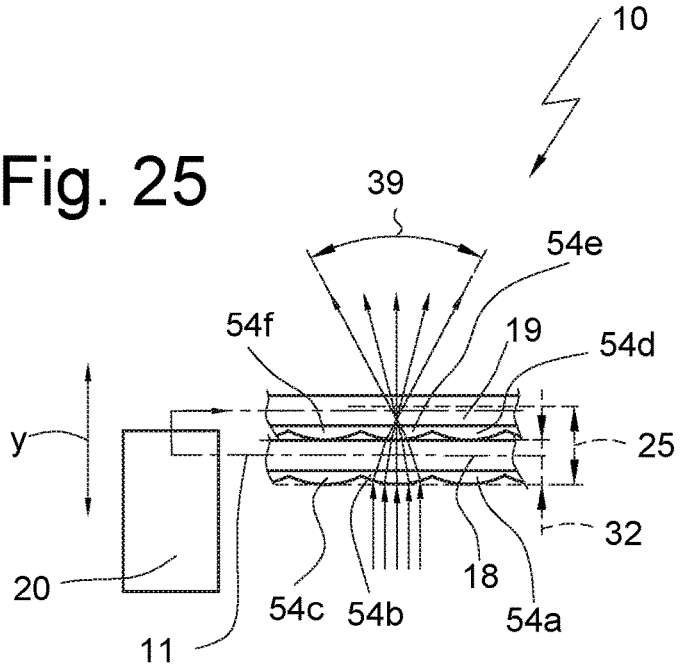
Figure 27:
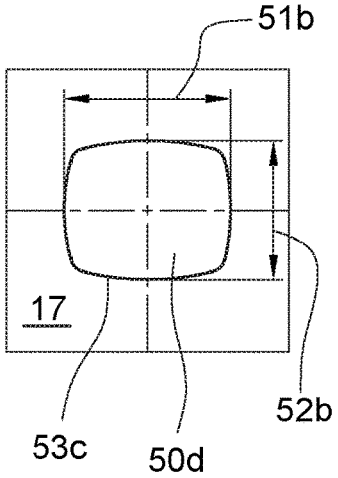
Figure 28:
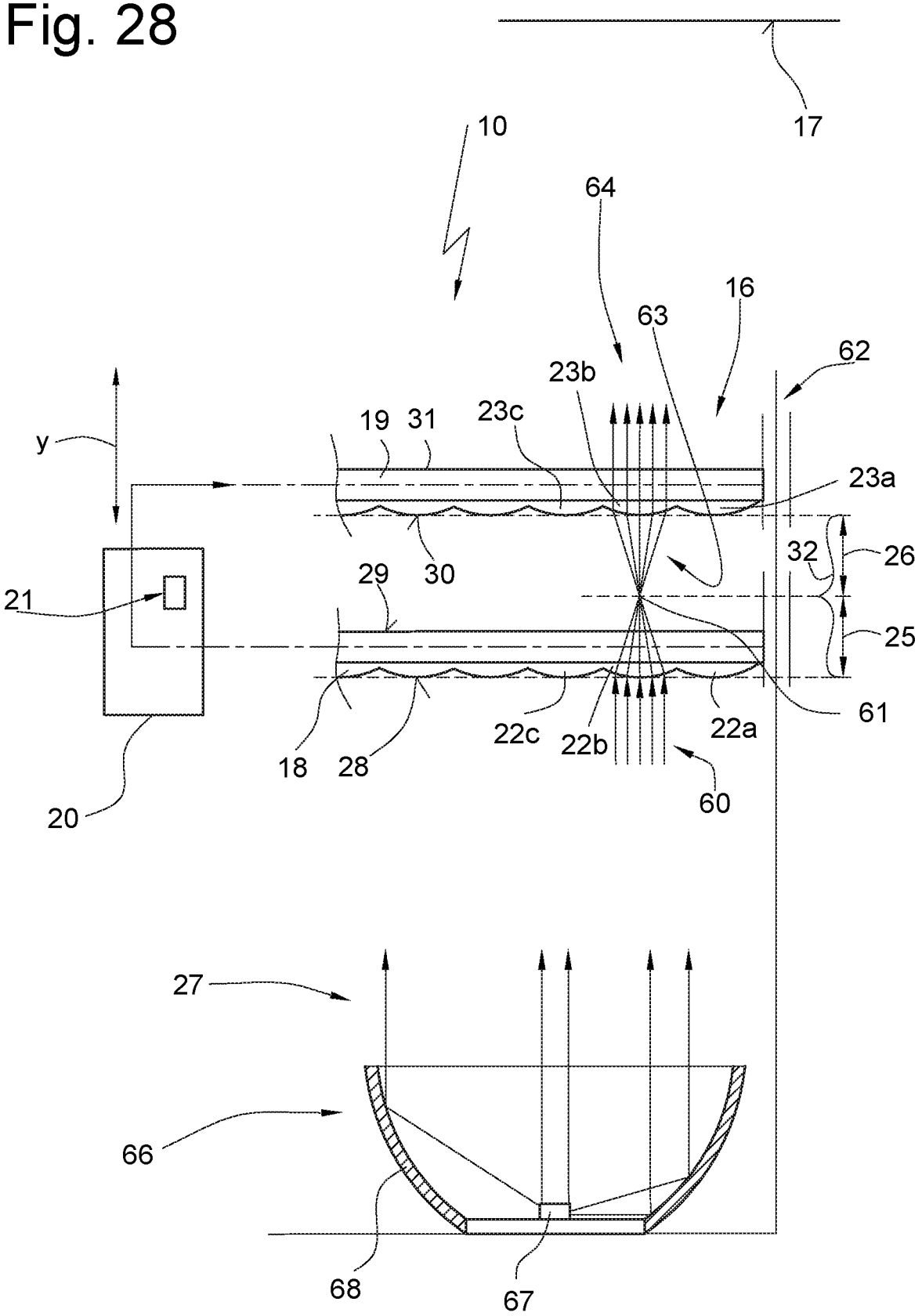
Figure 29:
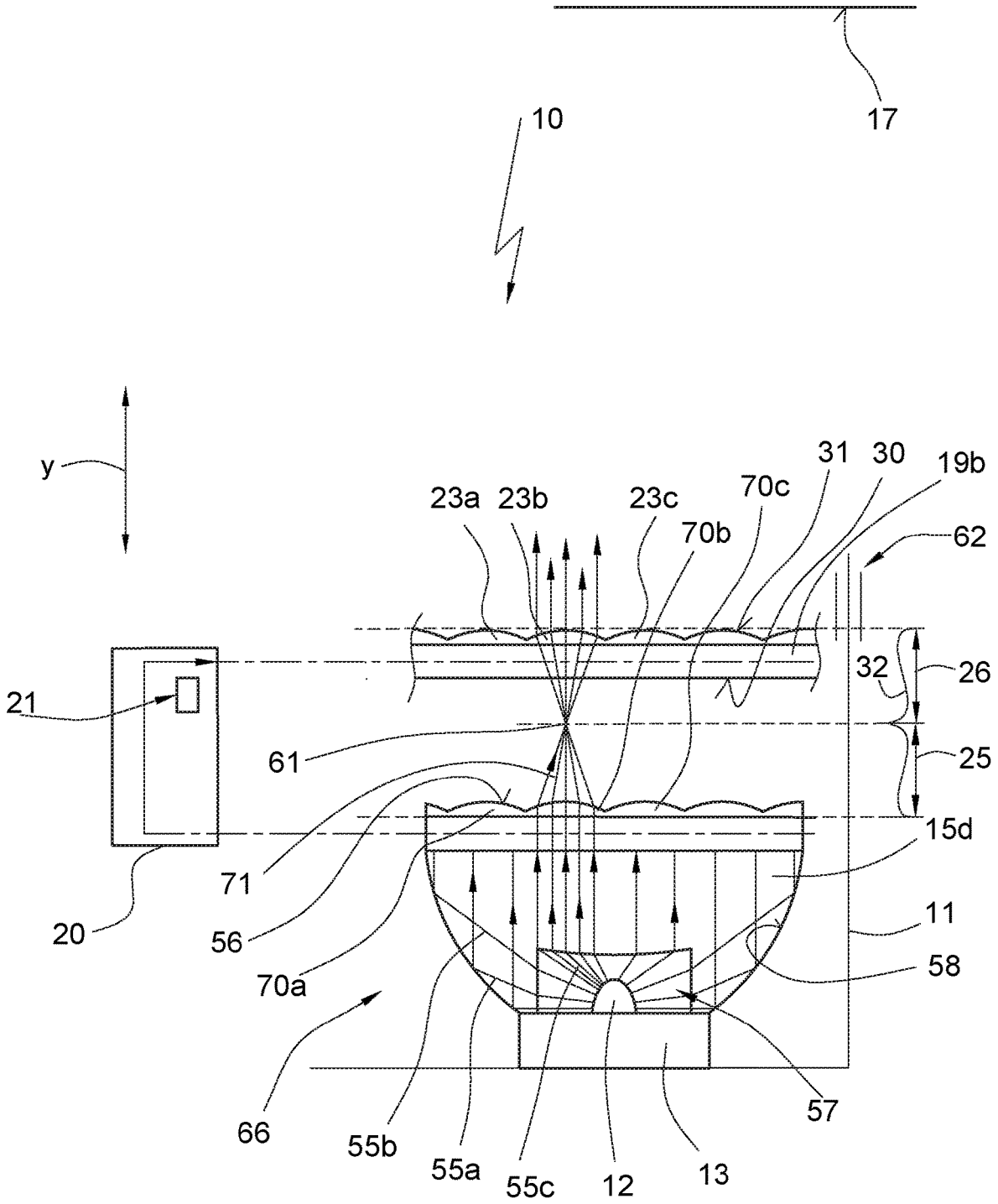
Figure 30:
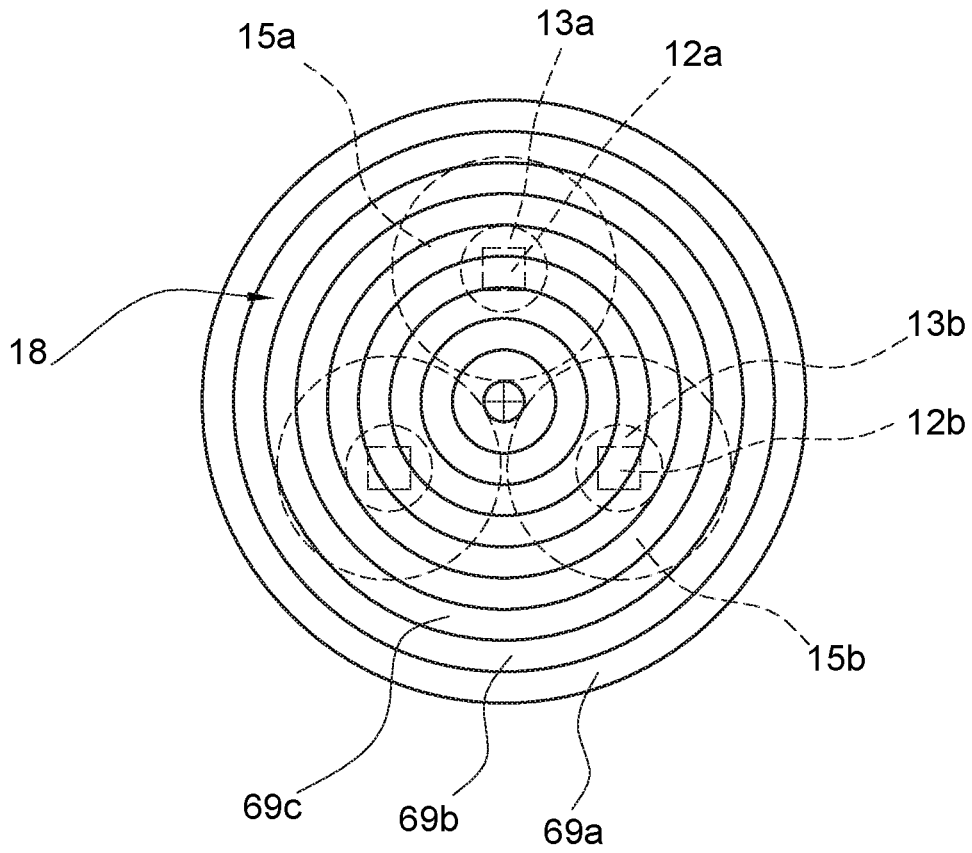
Figure 31:
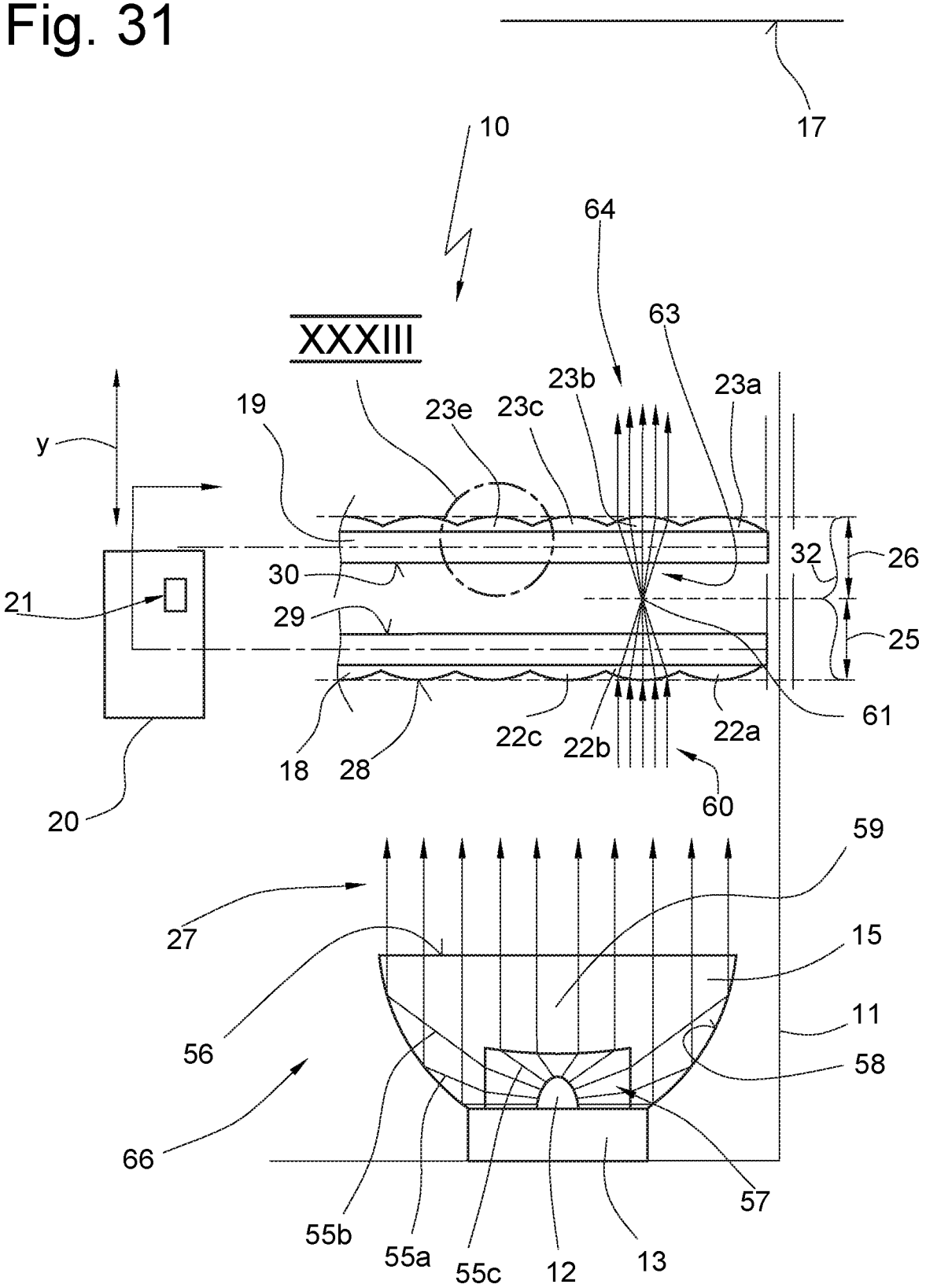
Figure 32:
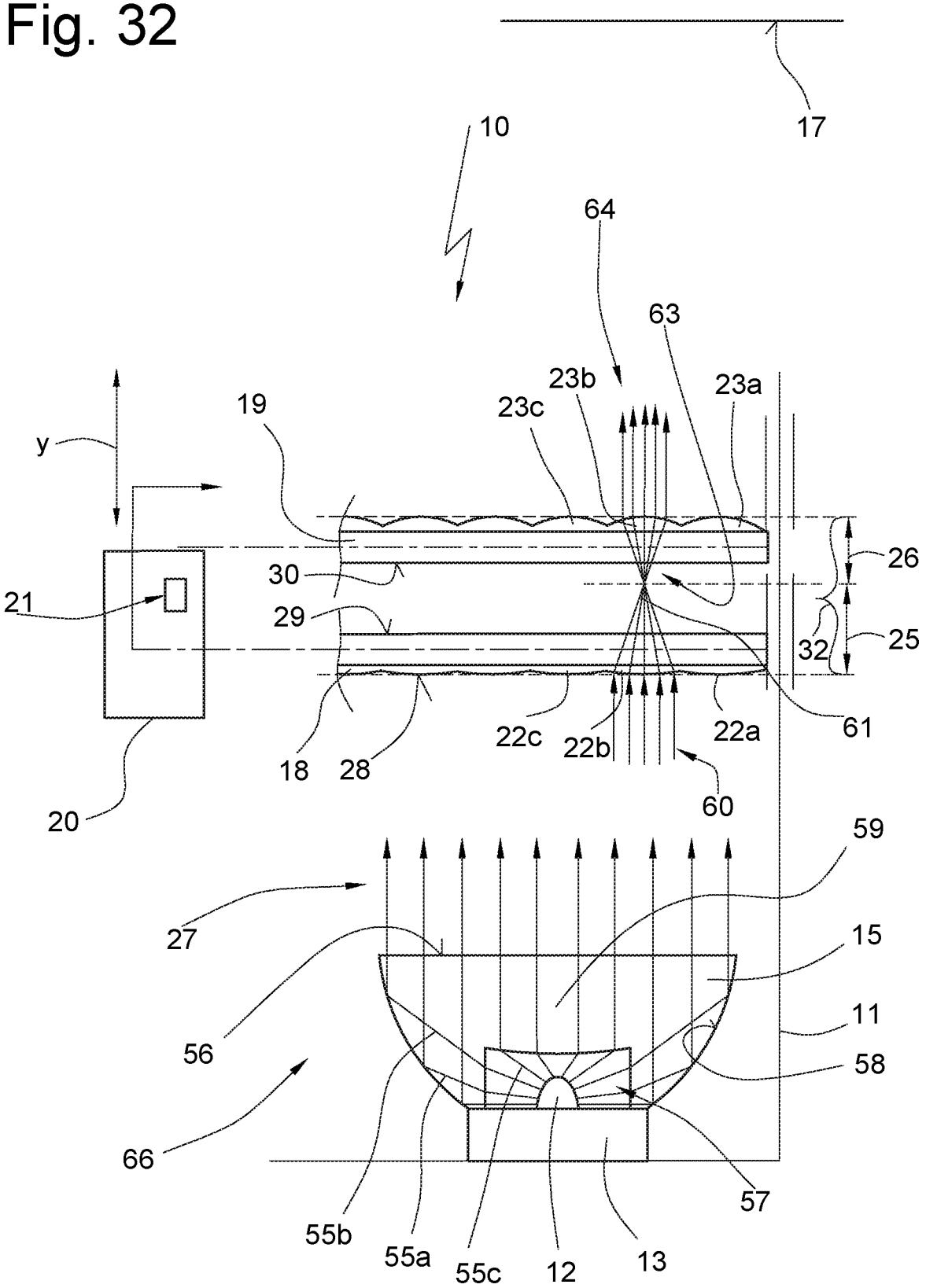
Figure 33:
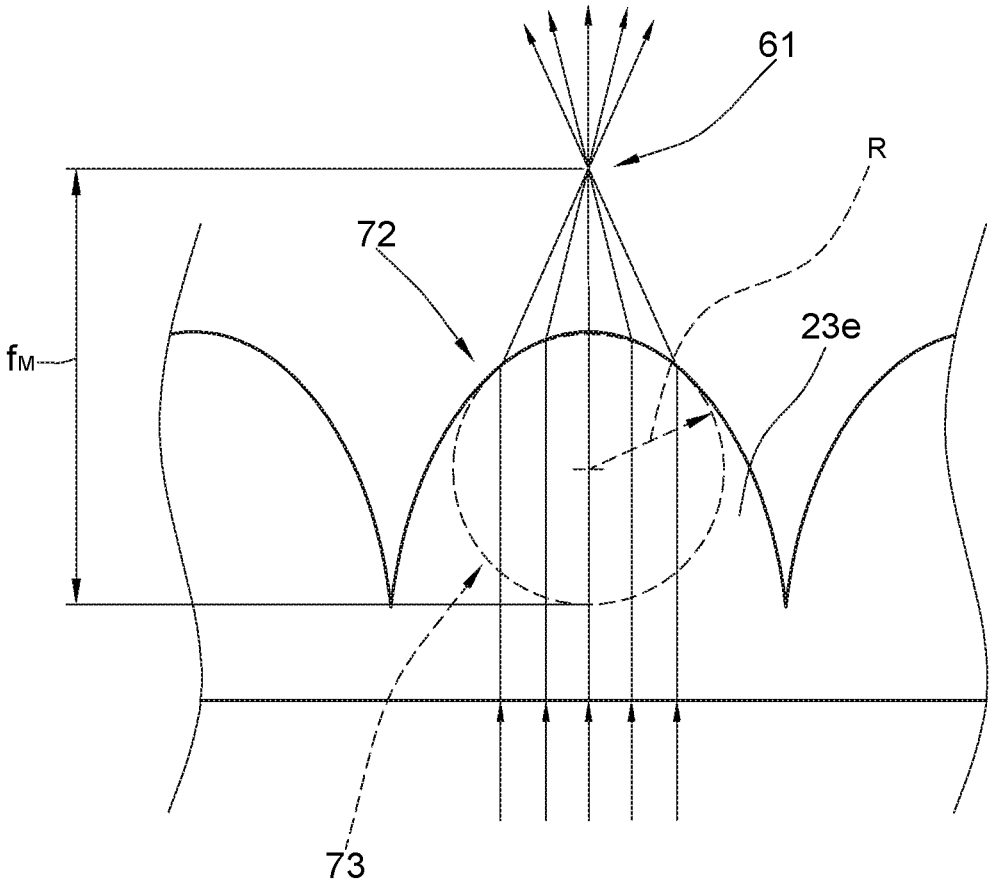

Further advantages of the invention are disclosed from the subclaims that are not quoted, and with reference to the following description of numerous embodiments shown in the figures, in which:

FIG. 1 shows in a partially sectional block diagram-type schematic view a first embodiment of a light fixture according to the invention with a light drive comprising an LED and a collimator and two lens plates that are adjustable relative to one another by an adjusting device, FIG. 2 shows in a cut-away schematic view from below approximately along the viewing arrow II in FIG. 1 a lens plate in plan view, indicating the relative positions of the light drives, FIG. 3 shows a further embodiment of a lens plate according to the invention in a view according to FIG. 2, FIG. 4 shows in a partially sectional schematic view a detail of the light fixture of FIG. 1 with an indicated adjusting device and the two lens plates in a first maximum spacing position, FIG. 5 shows an embodiment of FIG. 4 in a second spacing position, FIG. 6 shows the embodiment of FIG. 5 in a third spacing position with the two lens plates brought as close as possible to one another, FIG. 7 shows schematically a building surface to be illuminated with the light distribution generated by the light fixture of FIG. 1 on the building surface corresponding to the spacing position of the two lens plates according to FIG. 4, FIG. 8 shows the light distribution in a view according to FIG. 7 corresponding to the spacing position of the two lens plates according to FIG. 5, FIG. 9 shows the light distribution on the building surface corresponding to a view of FIG. 7 corresponding to a spacing position of the two lens plates according to FIG. 6, FIG. 10 shows a further embodiment of a light fixture according to the invention, illustrating a manually actuatable adjusting device in a partially sectional schematic view, illustrating an adjusting ring, FIG. 11 shows in a partially sectional schematic view a section through the light fixture of FIG. 10 approximately along the cutting line XI-XI in FIG. 10, FIG. 12 shows a partially sectional schematic plan view of the light fixture of FIG. 10, approximately along the viewing arrow XII in FIG. 10, FIG. 13 shows a cut-away partially sectional schematic view only of the adjusting ring in a detailed view, approximately along the viewing cutting line XIII-XIII of FIG. 12, FIG. 14 shows a further embodiment of a lens plate according to the invention in a view according to FIG. 2, illustrating lenticular lenses, FIG. 15 shows a partially sectional schematic view of the lens plates, approximately along the cutting line XV-XV in FIG. 14, FIG. 16 shows a further embodiment of a light fixture according to the invention, using two lens plates according to FIG. 14 in a view according to FIG. 4, FIG. 17 shows an illustration of the light distribution, of the light distribution produced by the light fixture of FIG. 16 in a view according to FIG. 7, FIG. 18 shows the light fixture of FIG. 16 with an altered spacing position of the two lens plates to one another, FIG. 19 shows the light distribution of the light fixture in a view according to FIG. 17 in a spacing position of the lens plates according to FIG. 18, FIG. 20 shows a further embodiment of a lens plate according to the invention, using lenticular facets in a view according to FIG. 14, FIG. 21 shows an enlarged schematic individual view of a single lenticular facet according to the part circle XXI in FIG. 20, FIG. 22 shows a partially sectional view through the facet of FIG. 21 along the cutting line XII-XII in FIG. 21, FIG. 23 shows a partially sectional view through the facet of FIG. 21 along the cutting line XXIII-XXIII in FIG. 21, FIG. 24 shows a further embodiment of a light fixture according to the invention, using a first lens plate according to FIG. 20, according to FIG. 24 a lower lens plate, and a second lens plate according to FIG. 14 in a view according to FIG. 16, FIG. 25 shows the light fixture of FIG. 24 with an altered spacing position of the lens plates to one another, FIG. 26 shows the light distribution of the light fixture of FIG. 24 on the building wall to be illuminated in a spacing position according to FIG. 24, FIG. 27 shows the light distribution on the building wall in the spacing position of FIG. 21, FIG. 28 shows a further embodiment of a light fixture according to the invention in a view according to FIG. 1, wherein in this embodiment the light drive is provided by a Chip on Board LED and a reflector is provided as a focusing optical unit, FIG. 29 shows a further embodiment of a light fixture according to the invention in a view according to FIG. 1, wherein here instead of two lens plates a collimator optical unit is provided with lens elements directly attached thereto and a lens plate arranged at a spacing that may be altered thereto, FIG. 30 shows a further embodiment of a lens plate according to the invention in a view according to FIG. 2, using centrally arranged annular lenticular lenses, FIG. 31 shows a further embodiment of a light fixture according to the invention in a view according to FIG. 1, wherein the lens plate remote from the collimator optical unit—in contrast to the view of FIG. 1—is arranged so as to be rotated by 180° or geometrically inverted and thus the lens elements are turned away from one another, FIG. 32 shows a further embodiment in a view according to FIG. 31, wherein the lens elements of the lens plate closest to the collimator optical unit have a larger radius and the lens elements of the opposing second lens plate have a smaller radius relative thereto, FIG. 33 shows a partially sectional cut-away and schematic view of a detail of the lens plate according to FIG. 31, approximately according to the part circle XXXIII in FIG. 31, and FIG. 34 in a view according to FIG. 31 shows a further embodiment of a light fixture according to the invention in which the lens elements of both lens plates are arranged on the respective side of the respective lens plate remote from the collimator optical unit.

Embodiments of the invention are described by way of example in the following description of the figures, and also with reference to the drawings. In this case for the sake of clarity—even if different embodiments are referred to—the same or comparable parts or elements or regions are denoted by the same reference numerals, in some cases by the addition of small letters.

Features that are only described with reference to one embodiment may also be provided within the scope of the invention in any other embodiment of the invention. Such altered embodiments are encompassed therewith by the invention—even if they are not shown in the drawings.

All of the disclosed features are essential to the invention. Thus the disclosure of the associated priority documents (copy of the prior application) and the quoted printed publications and the described devices of the prior art are also fully incorporated in the disclosure of the application for the purpose of including individual features or a plurality of features of these documents in one or in more claims of the present application.

An embodiment of a light fixture according to the invention is initially described with reference to FIG. 1:

Here a light fixture 10 that has a housing 11 is shown only very schematically. Inside the housing 11 that is shown and indicated only as a cut-away drawing, an LED 12 is arranged on a schematically indicated printed circuit board 13. The LED is supplied with the required operating voltage via voltage supply lines, not shown (denoted by 14 in FIG. 10, for example). Further electronic components that are provided for generating the operating voltage required for the LED are not shown for the sake of simplicity.

The LED radiates light distributed over a large spatial angular area of, for example, 180°. This is intended to be indicated by the light beams 55*a*, 55*b*, 55*c*. The LED 12 is located in a hollow portion 57 of a collimator optical unit 15 providing a focusing optical unit. The collimator optical unit 15 has total reflection surfaces 58 and a top portion 59. Overall the collimator optical unit 15 together with the LED 12 represent a light drive that serves for producing a substantially parallel light bundle 27.

Moreover, a first lens plate 18 and a second lens plate 19 are arranged within the light fixture housing 11. The parallel light beam bundle 27 emitted by the LED 12 and/or from the exit surface 56 of the collimator optical unit 15 is incident as a parallel partial light beam bundle 60 on the light entry surface 28 of the first lens plate 18, passes through this lens plate and emerges in the region of the light exit surface 29 of the first lens plate 18. From here the light is incident on the light entry surface 30 of the second lens plate 19 and emerges through the light exit surface 31 of the second lens plate 19.

No further optical element is arranged in the light path downstream of the second lens plate 19 in the embodiments shown in the figures of the light fixture according to the invention. From there, the light may be directly incident on a building surface 17 to be illuminated, which is indicated only schematically and not to scale in FIG. 1.

In this embodiment, therefore, a protective glass or the like is not provided in the region of the light outlet aperture 16 of the light fixture 10. In this case, the second lens plate 19 may function as a type of protective glass of the light fixture 16.

The spacing between the first lens plate 18 and the second lens plate 19 is denoted in the figures by 32. In this case, for example, the spacing is measured between the light entry surface 29 of the first lens plate 18 and the light entry surface 30 of the second lens plate 19. Other reference points are also encompassed by the invention.

According to the invention, the spacing 32 between the two lens plates 18, 19 is able to be altered by an adjusting device 20. The adjusting device 20 may comprise a motorized drive 21, which is only indicated in FIG. 1. The motorized drive 21, for example, may receive control commands from a light fixture control unit via a signal line or control line, not shown.

The adjusting device 20, however, may also comprise an actuating element that is able to be manually operated and entirely dispense with a motorized drive. With reference to the embodiment of FIGS. 10 to 13, to be described below in more detail, such an actuating element of a purely manually acting adjusting device is proposed.

According to the invention, however, the design of the adjusting device is not relevant. In principle, the invention is based on the fact that the two lens plates 18, 19 are displaceable relative to one another in the axial direction Y by altering the spacing 32 thereof from one another.

With reference to the embodiment of FIG. 1 it may be seen that a plurality of lens elements in the form of arched facets 22*a*, 22*b*, 22*c* are arranged along the light entry surface 28 of the first lens plate 18. The arrangement of the facets, for example, results from the different variants of the embodiments of FIGS. 2 and 3. The lens elements 22*a*, 22*b*, 22*c* in the form of arched facets are arranged immediately adjacent to one another. It is also encompassed by the invention if slight spacings are provided between the lens elements 22*a*, 22*b*, 22*c*.

Moreover, a plurality of lens elements 23*a*, 23*b*, 23*c* is arranged on the second lens plate 19. The two lens plates 18, 19 may be configured identically.

The individual facets 22*a*, 22*b*, 22*c* of the first lens plate 18 and/or the individual facets 23*a*, 23*b*, 23*c* of the second lens plate 19 may each have a spherical cross section and accordingly, for example, may be formed by a spherically arched body, for example a spherical section, or approximated to such a body. The facets may also be formed by a body with a different arched structure, for example an aspherical arched structure. In particular, the individual facets each may have a parabolic cross section and accordingly may be formed as a paraboloid of revolution.

With reference to the view of FIG. 1 each of the facets 22*a*, 22*b*, 22*c* has a focal length 25. This has the result that an incident beam bundle 60 consisting of parallel light, which for example according to FIG. 1 is incident on the facet 22*b*, is focused at a focal point 61. All individual light beams intersect at this point.

Following the path of the light further, the light diverges from the focal point 61 and is incident on the lens element 23*b* on the second lens plate 19. Since the facet 23*b* is arched identically to the facet 22*b* of the first lens plate 18, it may have an identical focal length 26. The focal length 25 of the facet 22*b* of the first lens plate 18 and the focal length 26 of the facet 23*b* of the second lens plate 19 are thus identical.

FIG. 1 shows a spacing of the two lens plates 18, 19 at a spacing 32 that corresponds to twice or approximately twice the focal length 25 (i.e. at the same time also double the focal length 26).

In this respect, the partial light beam bundle 63 coming from the focal point 61 and incident on the facet 23*b* is collimated again by the facet 23*b* and transformed into a parallel light beam bundle 64.

In addition, it should be mentioned that the block diagram-type schematic view in FIG. 1 indicates a linear guide 62. Accordingly, the first lens plate 18 is fixed relative to the housing 11 and the second lens plate 19 is displaceable in the axial direction Y relative to the first lens plate by the assistance of the adjusting device 20 along the linear guide 62.

With reference to FIGS. 2 and 3 it is clear that a plurality of lens elements 22*a*, 22*b*, 22*c* are arranged on each lens plate 18, 19, wherein only a portion of these facets is provided with reference numerals.

When viewed together with FIG. 1, in this embodiment it arises that the lens elements 22*a*, 22*b*, 22*c*, 23*a*, 23*b*, 23*c* are arranged each on the light entry side 28, 30 on the first lens plate and on the second lens plate 18, 19, and the light exit surface 29, 31 of the respective lens plate 18, 19 is kept planar.

In other embodiments, the respective lens plates 18, 19 may also be oriented differently so that, for example, the lens elements are arranged on the light exit side 29, 31 and the respective light entry side 28, 30 is kept free of lens elements. The orientation of the lens elements 22*a*, 22*b*, 22*c*, 23*a*, 23*b*, 23*c* relative to the light source 12 is not relevant according to the invention.

With reference to FIGS. 2 and 3 it is clear that the light fixture 10 may have a substantially circular light outlet aperture 16 and accordingly the two lens plates 18, 19 are also circular disk-shaped. However, the invention is not limited to this geometry. Light fixtures that have an outlet aperture that is square or rectangular or that have a different curve path, for example a polygonal curve path, are also encompassed by the invention.

From FIGS. 2 and 3 it is also clear that in the embodiment of FIGS. 1 to 3 each light fixture has three collimator optical units 15*a*, 15*b*, 15*c*. The number of collimator optical units 15, 15*a*, 15*b*, 15*c* may, however, be of any kind. The number of collimator optical units also depends, in particular, on the number and the configuration of the LEDs.

It is also clear from FIGS. 2 and 3 that each collimator optical unit 15 (and thus also each LED 12) has a plurality of individual lens elements 22*a*, 22*b*, 22*c*. Thus, for example, the view of FIG. 2 shows that the collimator optical unit 15*c* has more than twenty individual facets 22*a*, 22*b*, 22*c*.

As each collimator optical system 15 and/or each LED 12 is provided with a respective plurality of lens elements 22*a*, 22*b*, 22*c*, the structure of the light source 12 may be broken up and is no longer visible for an observer present in the room. Equally, the structures of the LEDs and/or the collimator optical unit are no longer visible in the light distribution on the building wall 17. The light distribution on the building wall is uniform.

According to an advantageous embodiment of the invention, the first lens plate 18 and the second lens plate 19 are configured identically. In particular, in the following description of the embodiments of FIGS. 4 to 9, it should now be further assumed that the first lens plate 18 is provided with a plurality of facet-like lens elements 22*a*, 22*b*, 22*c* and the second lens plate 19 is provided with a plurality of further facet-like lens elements 23*a*, 23*b*, 23*c*, wherein the lens elements 22*a*, 22*b*, 22*c* of the first lens plate 18 and the lens elements 23*a*, 23*b*, 23*c* of the second lens plate 19 are configured identically to one another and positioned identically to one another.

If two identically configured lens plates 18, 19 are relatively positioned axially spaced apart from one another, as shown in FIG. 4, the positioning is carried out such that a further lens element of the second lens plate 19 is fixed to each lens element of the first lens plate 18. Thus with reference to FIG. 4 the lens element 22*b* of the first lens plate 18 is always fixed to the lens element 23*b* of the second lens plate 19. This fixed assignment remains even after carrying out an alteration to the spacing between the lens plates 18, 19.

With reference to FIGS. 4 to 6, in one embodiment of the invention an alteration to the spacing 32 may be made by the adjusting device 20 between a first spacing according to FIG. 6, which corresponds to a minimal spacing, and wherein it results or may result approximately in contact between the entry side 30 of the second lens plate 19 and the exit side 29 of the first lens plate 18, and a second maximum spacing 32 according to FIG. 4, wherein the two lens plates 18, 19 are spaced apart from one another by approximately double the focal length 25, 26. In this case, the displacement may be carried out by the adjusting device, for example continuously, in particular steplessly.

The light distribution generated on the building surface 17 corresponding to the different spacings of the two lens plates 18, 19 according to FIGS. 4 to 6, is intended to be described with reference to FIGS. 7 to 9:

In a spacing position according to FIG. 4 in which the spacing of the two lens plates 18, 19 to one another corresponds to approximately double the focal length 25, 26, the radiation angle 37 is minimal. It is 0° according to the schematic view of FIG. 4 since it is parallel light. In reality, with regard to the large actual spacing between the building surface 17 and the light fixture 10, naturally not shown to scale in FIG. 1, the radiation angle 37 for example is approximately 12 to 16°. This radiation angle already corresponds to the radiation angle of the light emitted by the collimator optical unit 15.

If by means of the adjusting device 20 the two lens plates 18, 19 are moved toward one another, reducing the spacing 32, and for example an intermediate position according to FIG. 5 with a spacing 32 is reached, the second lens plate 19 is no longer able to focus to a maximum extent the light received by the first lens plate 18. FIG. 5 illustrates that the lens element 23*b* is able to collimate the light beam bundle received by the lens element 22*b* only to a smaller degree and correspondingly a second radiation angle 38 is provided. This second radiation angle 38 is greater than the first radiation angle 37.

Whilst FIG. 7 shows the light distribution that approximates a spotlight distribution, the light cone with reference to FIG. 8 is already widened, —corresponding to the spacing position of the lens plates 18, 19 according to FIG. 5. Both the height 52*b* and the width 51*b* of the light distribution according to FIG. 8 are considerably greater than the height 52*a* and the width 51*a* of the light distribution according to FIG. 7.

Assuming that the light distribution of FIG. 7 represents a spotlight-light distribution, the light distribution of FIG. 8 already provides a floodlight-light distribution.

If proceeding from a spacing position according to FIG. 5, the two lens plates 18, 19 are moved further toward one another and a contact position or approximately a contact position according to FIG. 6 is reached, no focusing or approximately no focusing of the light received by the first lens plate 18 is carried out by the second lens plate 19. Here the radiation angle 39 is considerably greater than the radiation angle 38 in the spacing position according to FIG. 5.

Accordingly, the light distribution on the wall 17 according to FIG. 9 has an even greater height 52*c* and width 51*c*, compared with the light distribution curve according to FIG. 8.

A wide floodlight-light distribution is achieved here.

By the alteration of the spacing between the lens plates 18, 19 and the fixed assignment of the lens elements 22*a*, 22*b*, 22*c* of the first lens plate 18 to the lens elements 23*a*, 23*b*, 23*c* of the second lens plate 19, an alteration to the radiation characteristic of the light fixture 10, in particular an alteration to the radiation angle 37, 38, 39, may be achieved.

An embodiment of the invention with an adjusting device 20 that has a manual adjusting member is described with reference to FIGS. 10 to 13.

According to the embodiment of FIG. 10, the light fixture 10 has a first lens plate 18 that for the sake of simplicity is shown without lens elements. The lens plate 18 is fixed relative to the housing 11. The lens plate 19 is adjustable relative to the housing 11 and relative to the first lens plate 18 and in the axial direction along the arrow Y. Also the lens plate 19 has lens elements that, however, also for the sake of clarity are not shown.

The second lens plate 19 is fixedly attached to a ring holder 40. The ring holder 40 has an annular body that encompasses the second lens plate 19. Three sliding blocks 41*a*, 41*b*, 41*c* (see FIG. 10, FIG. 11) are arranged on the annular body so as to be offset over the periphery by approximately 120° and to protrude radially over the edge of the ring holder 40.

The ring holder 40 further has three positioning devices 42*a*, 42*b*, 42*c* that each comprise a positioning projection 43*a*, 43*b*, 43*c*. A positioning receiver 44*a*, 44*b*, 44*c* on the housing 11 is associated with each positioning projection 43*a*, 43*b*, 43*c* on the ring holder 40.

FIG. 10 shows two positioning projections 43*a* and 43*b* and the associated positioning receivers 44*a*, 44*b*.

The positioning devices 42*a*, 42*b*, 42*c* ensure a rotational connection between the light fixture housing 11 and the ring holder 40. The ring holder 40 is axially displaceably arranged relative to the light fixture housing 11 and namely in the direction of the double arrow Y, i.e. in the axial direction but not rotatable relative to the light fixture housing 11 about the central longitudinal axis 65 of the light fixture 10.

With reference to FIG. 10 the adjusting device 20 also has an adjusting ring 47.

By means of a collar receiver 46 said adjusting ring encompasses an outwardly protruding collar 45 of the housing 11. The adjusting ring 47 is in this regard rotatable about the longitudinal central axis 65 of the light fixture 10 but in the axial direction Y is prevented by the collar 45 from a relative axial movement with regard to the light fixture housing 11.

Three guide slots 48*a*, 48*b*, 48*c* are arranged on the adjusting ring 47, said guide slots serving for receiving the sliding blocks 41*a*, 41*b*, 41*c*. The three guide slots 48*a*, 48*b*, 48*c*, as visible for example in FIG. 11, are each arranged offset on the periphery by 120° and, for example, may extend over an angular range of approximately 75°.

With reference to FIG. 13, it is clear from a cut-away internal view of the adjusting ring 47, in a separate view, that the guide slots 48, 48*a*, 48*b*, 48*c* extend in a helical manner.

If proceeding from FIG. 10 the adjusting ring 47 is actuated, i.e. rotated relative to the housing 11, as a result the second lens plate 19 is moved, i.e. axially displaced, from its lower position shown in solid lines in FIG. 10 into its upper position shown in dashed lines in FIG. 10.

As a result, the spacing 32 between the first lens plate 18 and the second lens plate 19 is altered.

During the alteration to the spacing, the rotary peripheral position of the second lens plate 19 is maintained relative to the first lens plate 18 by the positioning device 42*a*, 42*b*, 42*c*, even during the adjusting process. This ensures that the fixed assignment of one respective specific lens element 22*a*, 22*b*, 22*c* on the first lens plate 18 relative to one respective specific lens element 23*a*, 23*b*, 23*c* on the second lens plate 19 is maintained in different spacings 32.

A further embodiment of the light fixture according to the invention is described with reference to FIGS. 14 to 19.

With reference to FIGS. 14 and 15, in this embodiment each lens plate 19 has lenticular lenses. In this case, the lenses are cylindrical lenses that have spherical or aspherical curvatures along a first cutting plane (see FIG. 15) and that are not curved along a second cutting plane perpendicular to the first cutting plane. The lenticular lenses 49*a*, 49*b*, 49*c* are in this respect configured to be cylindrical and are aligned parallel to one another.

With reference to FIGS. 16 and 18, in the embodiment of the invention, two identically configured lens plates 18, 19 are positioned relative to one another so that the two lenticular lens elements 49*a*, 49*b*, 49*c* of the first lens plate 18 and the two lenticular lens elements 49*a*, 49*b*, 49*c* of the second lens plate 19 are aligned parallel to one another.

In this case once again it applies that a specific lens element (for example the lens element 49*b*) of the first lens plate 18 is provided with a specific lens element (for example the lens element 49*e*) on the second lens plate 19, wherein this assignment is once again maintained in the case of different spacings 32.

FIGS. 16 and 18 illustrate different spacings of the two lens plates 18, 19.

With reference to the light distributions of FIGS. 17 and 19 it may be identified that this light fixture according to FIGS. 24 and 25 generates an oval light distribution, even in the case of different spacings of the two lens plates 18, 19. "Oval light distribution or illumination intensity distribution" on the wall 17, is usually understood by the person skilled in the art as a light distribution that has a contour 53 deviating from a circular shape of light distribution, as shown for example according to FIGS. 7, 8 and 9.

Thus FIG. 17 shows an oval light distribution 50*a* with a correspondingly oval contour 53*a* and a light distribution—shown simplified—that has a width 51*a* of the light distribution and a height 52*a* of the light distribution. The light distribution is thus oval or approximately elliptical. The exact contour 53*a* of the light distribution 50*a* naturally depends on the radii of curvature used.

When the spacing of the two lens plates 18, 19 from one another reduces, the light distribution on the building surface 17 to be illuminated becomes broader. FIG. 19 shows the light distribution 53*a* on the building surface 17 to be illuminated that corresponds to the spacing position of the two lens plates 18, 19 according to FIG. 18. It may be identified that the width 51*b* of this light distribution 53*c* is considerably larger than the width 51*a* of the light distribution 53*a* of FIG. 17. This effect has the result that the lens elements (listed by way of example) 49*d*, 49*e*, 49*f* each may no longer collimate the partial light bundle received by the lens elements 49*a*, 49*b*, 49*c* of the first lens plate 18 as effectively or as fully as in the spacing position shown in FIG. 16.

Accordingly, the radiation angle 39*c* as indicated in FIG. 18 is considerably greater than the radiation angle 37 of FIG. 16. In this case, once again it is noted that the radiation angle 37 according to FIG. 16 according to the schematic view is actually 0° here, since in this case a parallel light beam bundle is shown. On the other hand, it is clear to the person skilled in the art that actually a maximum narrow light distribution of, for example, 8° with a spacing position according to FIG. 16 is achieved.

In any case, it is significant that the light distribution 53*c* is altered in its width 51*b* by the alteration of the spacing 32 between the lens plates 18, 19 and thus the radiation angle 37, 39 is increased in the cutting plane of FIGS. 16 and 18.

In a cutting plane perpendicular thereto, the radiation angle is not influenced. This explains why the height 52*b* of the light distribution 53*c* in practice does not deviate from the height 52*a* of the light distribution 53*a* according to FIG. 17.

A further embodiment of a light fixture 10 according to the invention is intended to be described further with reference to FIGS. 20 to 27.

FIG. 20 shows in a view according to FIG. 2 a further embodiment of a lens plate 18 that now has so-called lenticular facets 54*a*, 54*b*, 54*c*. In this case they are facets that, for example, may have a more complex arched structure.

With reference to FIGS. 20 to 23, it is clear that facets 54*a*, 54*b*, 54*c* may be arranged in a predetermined pattern. In this case it may be provided, in particular, that the arrangement of these facets 54*a*, 54*b*, 54*c* according to the view of FIG. 20 is implemented in a pattern that has lines and columns. The number of columns may in this case be calculated such that it corresponds to the number of lenticular lenses of a lens plate 18 according to FIG. 14.

Each column of this facet arrangement in this case may be subdivided into a plurality of individual facets.

These lenticular facets may have a particularly arched surface with two different radii of curvature.

With reference to FIG. 21, a single lenticular facet 54 from the lens plate 18 according to FIG. 20 is considered in an enlarged individual view. The two sectional views of FIGS. 22 and 23 make clear that different radii of curvature may be provided along different cutting planes perpendicular to one another. In this case, for the sake of simplicity it has been assumed that all facets 54*a*, 54*b*, 54*c* of the lens plate 18 are configured identically.

It might also be mentioned that the facets according to the sectional views of FIGS. 22 and 23 have radii of curvature, wherein it is clear to the person skilled in the art that also other curved surfaces, such as for example elliptical or parabolic curvatures, may be used.

FIGS. 24 and 25 now show a light fixture according to the invention in which each first lens plate 18 has a lens plate 18 according to FIG. 20 and the second lens plate 19 is provided by a lenticular lens plate according to FIG. 14.

Once again—with reference to the view of the previous embodiments—in FIGS. 24 and 25 two different spacings of the two lens plates 18, 19 from one another are shown.

With reference to FIG. 24 a spacing position is indicated in which the spacing 32 approximately corresponds to double the focal length 25. In this case, a maximum focusing of the light takes place. Due to the selected arched structures of the individual lens elements 54*a*, 54*b*, 54*c*, 54*d*, 54*e*, 54*f* once again an oval light distribution 50*c* is generated on the building surface to be illuminated. This surface has an oval light contour 53*a* with a notional light distribution width 51*a* and a notional light distribution height 52*a*.

The height 52*a* and width 51*a* in this case may correspond, but do not necessarily have to correspond, to the light distribution 50*a* according to FIG. 17.

Proceeding now from a spacing position according to FIG. 24, if an alteration to the spacing is carried out by the adjusting device 20, and the two lens plates 18, 19 are brought closer to one another until a contact position is reached according to FIG. 15, the lens elements 54*d*, 54*e*, 54*f* are no longer able to collimate the light received by the respective lens elements 54*a*, 54*b*, 54*c* on the first lens plate 18 or no longer able to focus the light to a specific degree. The light distribution in this regard is broader which results in a larger radiation angle 39 relative to the radiation angle of FIG. 24. In this case it might be assumed that—as visible in FIG. 27—now the height 52*b* of the light distribution 50*d* according to FIG. 27 is considerably greater than the height 52*a* of the light distribution 50*c* of FIG. 26. This view, however, is based on the fact that the cutting planes of FIGS. 24 and 25 are now viewed in a plane perpendicular to the cutting planes of FIGS. 16 and 18. Otherwise, the height 52*b* would not increase in comparison with the height 52*a* of the light distribution 50*c* but rather the width.

When observing FIGS. 26 and 27 it is also clear that the light distributions 50*c* and 50*d* have a constant width 51*a*, 51*b*. This width is predetermined by the radiation angle that corresponds to the corresponding other curvature (i.e. the curvature not shown in FIG. 25) of the corresponding lenticular facets 54.

FIGS. 22 and 23 show both curvatures along different cutting planes, wherein it has been assumed that FIG. 25 only shows the cutting plane corresponding to FIG. 23.

The radiation angle produced by the curvature according to FIG. 22, i.e. also a widening of the parallel light beam bundle received by the first lens plate 18, ensures in the embodiment of FIGS. 24 to 27 the predetermined width 51*a*, 51*b* of the corresponding light distribution 50*c*, 50*d* and in this embodiment is not able to be altered.

According to the embodiments of the drawings, each of the plurality of facets 22*a*, 22*b*, 22*c*, 23*a*, 23*b*, 23*c*, 49*a*, 49*b*, 49*c*, 49*d*, 49*e*, 49*f*, 54*a*, 54*b*, 54*c*, 54*d*, 54*e*, 54*f* is identically configured on one lens plate 18, 19. However, it is also encompassed by the invention if different facets, for example different types of facets, are arranged on a lens plate 18, 19.

It is further encompassed by the invention that entirely different facets are arranged on a lens plate, for example free-form bodies calculated by the assistance of simulations.

In the embodiments of the invention, an alteration to the spacing of the two lens plates 18, 19 from one another takes place by an axial movement, wherein the two lens plates in each spacing position are aligned parallel to one another. It is also encompassed by the invention if, instead of such an alteration to the spacing between the lens plates 18, 19, a displacement movement is carried out by the adjusting device 20 such that in addition to an axially oriented parallel displacement movement or alternatively to such a movement, an alteration to the spacing takes place between the lens plates 18, 19 relative to one another by one of the two lens plates 18, 19 being tilted or inclined relative to the respective other lens plate 19, 18 or being subjected to a further movement that is potentially more complicated in nature. Moreover, it may be ensured here that each assignment of a lens element of a lens plate to a different lens element of a different lens plate is fixedly maintained.

However, embodiments are also encompassed by the invention in which this assignment is dispensed with during an alteration to the spacing and, for example, in each case different lens elements of the first lens plate are associated with different lens elements of the second lens plate in different discrete spacings.

Finally, embodiments are exclusively shown in the drawings in which the rotational position of the second lens plate 19 is maintained relative to the first lens plate 18 during an alteration to the spacing. However, embodiments are also encompassed by the invention in which, due to an alteration to the spacing between the lens plates 18, 19, an alteration to the rotational position of the second lens plate 19 takes place relative to the first lens plate 18.

The invention encompasses at least two lens plates 18, 19 that are able to be altered relative to one another in terms of spacing. Light fixtures are also encompassed by the invention in which one or more additional lens plates are provided.

The method for altering the radiation characteristic of a light fixture may be carried out as follows:

Assuming that in a museum during the period of a temporary exhibition a work of art of a specific format is illuminated by a light fixture according to the invention. After this exhibition has finished, a new work of art with a different format is intended to be illuminated by the same light fixture on the same building surface or a different building surface. In order to adapt the light distribution of the light fixture to this alteration to the format of the work of art, an alteration to the spacing of the two lens plates 18, 19 to one another may be undertaken by an operator in the desired manner by the adjusting device 20.

The alteration of the light distribution or radiation characteristic of the light fixture is able to be carried out without specific elements of the light fixture having to be exchanged or replaced, or even the light head of the light fixture having to be exchanged or replaced.

In the embodiments of the invention, an axial displacement of the second lens plate 19 relative to the first plate 18 takes place by an adjusting path that is approximately double the focal length 25 of the lens elements 22*a*, 22*b*, 22*c* of the first lens plate 18. Moreover, embodiments are encompassed by the invention in which the adjustment path that is provided by the adjusting device 20 for altering the spacing 32 between the lens plates 18, 19 is accordingly slightly larger or considerably larger or slightly smaller or considerably smaller.

In the event that the lens elements 22*a*, 22*b*, 22*c* of the first lens plate 18 provide different focal lengths 25, the movement path to be provided on the adjusting device 20 may be dictated by the focal length or double the focal length 25 of one of the facets 22*a*, 22*b*, 22*c*.

Advantageously, the movement path to be provided by the adjusting device 20 is dimensioned such that an alteration to the spacing between the lens plates 18, 19 is provided between a first optimized spacing in which a minimum radiation angle is generated, i.e. light oriented approximately in parallel, and a second spacing position that generates a maximum radiation angle predetermined by the curvature of the lens elements.

These two different spacings between the lens elements 18, 19, which correspondingly provide a maximum radiation angle and a minimum radiation angle, may also be predetermined or previously determined by stops that are provided by the adjusting device 20, and correspondingly delimit a displacement movement of the second lens plate 19 relative to the first lens plate 18.

In the event that the alteration to the spacing between the lens plates 18, 19 is to take place in discrete steps in order to ensure predetermined spacings between the lens plates 18, 19 (for example in order to permit specific optimized light distributions, for example particularly uniform light distributions) latching positions may also be predetermined along the movement path, i.e. positions in which the spacing position between the two lens plates 18, 19 may be identified or may be determined by an operator or by an electronic or mechanical sensor or by a control unit. As a result, for example, it can be ruled out that specific intermediate positions between predetermined latching positions are not reached.

According to the embodiments of the invention, conventional LEDs 12, 12*a*, 12*b*, 12*c* and conventional collimator optical units 15, 15*a*, 15*b*, 15*c* may be used. In this case lens elements 22*a*, 22*b*, 22*c*, 23*a*, 23*b*, 23*c*, which are of aspherical configuration but that may be described approximately by a sphere, may be used, wherein the sphere, for example, may have a diameter of curvature of between 1 and 50 mm.

For example, adjusting paths of between 2 and 40 mm, preferably adjusting paths in the order of approximately 4 to 6 mm, are provided as typical adjusting paths to be provided by the adjusting device 20, an alteration to the spacing being able to take place between the two lens plates 18, 19 along said adjusting paths.

In order to prevent a break-up of the structures of the LED 12 and the collimator optical unit 15, in order to generate an illumination intensity distribution or light distribution on the building surface 17 that is as uniform as possible, for each collimator optical unit 15, 15*a*, 15*b*, 15*c* and/or for each LED 12, 12*a*, 12*b*, 12*c* and/or LED group—for example in the case of the use of a multichip LED—approximately 10 to 50 lens elements 22*a*, 22*b*, 22*c* are provided on the lens plate 18. As a result, a particularly optimized homogenisation of the light that is incident on the two lens plates 18, 19 and/or emitted by the lens plates 18, 19 may be carried out.

With reference to the embodiments, the collimator optical unit 15 has a hollow portion 57, total reflection surfaces 58 and a top region 59, i.e. a conventional lens centrally at the middle of the collimator optical unit 15. Other suitable collimator optical units that are configured differently and that focus the light emitted by the corresponding light source are also encompassed by the invention.

According to the invention, for providing a light fixture 10 according to the invention reference will be made back to conventional lens plates 18, 19 that have been used by the Applicant for many years, for example, as tertiary optical units in light fixtures. In this case, by arranging a second additional lens plate on a light fixture which already has a lens plate, there is also the possibility of retrofitting the light fixture within the context of a retrofitted assembly kit and providing the light fixture with an adjusting device 20 for altering the light characteristic.

With reference to the embodiment of FIG. 28 reference is made briefly to a further embodiment that corresponds in its view according to FIG. 28 to the view of FIG. 1. Here a focusing optical unit 66 that replaces the focusing optical unit 66 of FIG. 1 is provided. In the embodiment of FIG. 28 a reflector 68 is provided as a focusing optical unit 66 that cooperates with an arrangement of a Chip on Board LED 67 that is arranged inside the reflector 68 or that is provided with a reflector 68. The reflector 68, together with the Chip on Board LED 67, also emits a light beam bundle 27 of parallel light or approximately parallel light.

The arrangement of the two lens plates 18, 19 may be equal in the embodiment of FIG. 28, as in the embodiment of FIG. 1. The light distribution of the light fixture 10 corresponds at different spacings 32 to the altered light distributions that are produced in FIGS. 4 to 9.

A further embodiment of a light fixture 10 according to the invention according to FIG. 29 provides a focusing optical unit 66 that has a collimator optical unit 15*d* with lens elements 70*a*, 70*b*, 70*c* arranged directly thereon. The lens elements 70*a*, 70*b*, 70*c* are thus arranged on the light exit side 56 of the collimator optical unit 15*d* that—in contrast to the embodiment of FIG. 1—is not kept smooth but has the plurality of lens elements 70*a*, 70*b*, 70*c*.

With reference to an exemplary light beam bundle 71, it may be derived from FIG. 29 that the light radiation behaviour of this light fixture corresponds to that of the embodiment of FIG. 1.

The second lens plate 19*b* of the embodiment of FIG. 29 corresponds to the second lens plate 19 of the embodiment of FIG. 1. The fact that in this case the lens elements 23*a*, 23*b*, 23*c* are arranged on the light exit side 31 of the second lens plate 19*b* and the light entry side 30 is kept flat, is irrelevant. The orientation of the second lens plate 19*b* could also be reversed in the embodiment of FIG. 29.

The different spacings of the lens plate 19*b* from the collimator optical unit 15*d* of the embodiment of FIG. 29, result in exactly the same alterations to the radiation characteristic of the light fixture as are shown in FIGS. 4 to 9 in the embodiment of FIG. 1.

Once again it is clear that the lens plate 19*b* may also cover a plurality of corresponding collimator optical units 15*d*.

With reference to the embodiment of FIG. 30, a further lens plate 18 is proposed. The view of FIG. 30 corresponds in this case to the view of FIG. 2.

Instead of facet-like lens elements 22*a*, 22*b*, 22*c*, according to the embodiments of FIGS. 2 to 3 and instead of lenticular-shaped lens elements 49*a*, 49*b*, 49*c* according to the embodiment of FIG. 14, here circular, concentrically arranged lenticular lens elements 69*a*, 69*b*, 69*c* are provided.

In an embodiment, not shown, of a light fixture according to the invention, two lens plates 18, 19 are used, as shown in FIG. 30. This results, for example, in the same cross-sectional view as is indicated in FIG. 1 schematically but not to scale.

If the two lens plates 18, 19 according to FIG. 30 are arranged at different spacings, this results in identical light distributions according to FIGS. 4 to 9 relative to the embodiment of FIG. 1. The advantage of an arrangement of two lens plates 18, 19 according to FIG. 30 in a light fixture according to FIGS. 4 to 6 is that in this case, with a displacement of the second lens plate element 19 relative to the first lens plate element 18, this relative peripheral position does not have to be maintained but due to the rotational symmetry of this element 18, 19 it may also be altered with an axial displacement movement without influencing the light distribution.

According to a further embodiment of the invention, not shown, one or more of the lens plates 18, 19, 19*b* are configured to be curved or arched, in contrast to those in the different embodiments of the patent application.

Alternatively, the lens plates 18, 19—as shown in the drawings—may be aligned in one plane.

With reference to the embodiment of FIG. 31, the lens elements may also be arranged remotely from one another, so that the lens elements 22*a*, 22*b*, 22*c* of the first lens plate 18 face the collimator optical unit 15 and the lens elements 23*a*, 23*b*, 23*c* of the second lens plate 19 are arranged on the side of the second lens plate 19 that is remote from the collimator optical unit 15.

The embodiment of FIG. 32 finally relates to the basic structure of the embodiment of FIG. 31: Here, however, in contrast to the embodiment of FIG. 31, the lens elements 22*a*, 22*b*, 22*c* of the first lens plate 18 are provided with a first radius so that a first focal length 25 may be associated with the corresponding lens elements 22*a*, 22*b*, 22*c*.

The lens elements 23*a*, 23*b*, 23*c* of the second lens plate 19 accordingly have a smaller radius so that a focal length 26 that is smaller than the focal length 25 may be associated with each lens element 23*a*, 23*b*, 23*c* of the second lens plate 19. This is a particularly advantageous embodiment.

According to the invention, the group of features according to which the lens elements 22*a*, 22*b*, 22*c* of the first lens plate 18, in their entirety or in the majority, or in any case on average, have a greater radius and/or a greater focal length than the lens elements 23*a*, 23*b*, 23*c* of the second lens plate 19, may be advantageously used in all embodiments.

The advantage of this particular geometry is, inter alia, that the light beam bundle emitted from a specific lens element (for example 22*b*) of the first lens plate 18, in reality in a very reliable manner, is only incident on a corresponding opposing lens element 23 of the second lens plate 19.

It should be mentioned that the differences in the focal lengths and/or the differences in the mean or average focal lengths between the lens elements 22*a*, 22*b*, 22*c* of the first lens plate 18 and the lens elements 23*a*, 23*b*, 23*c* of the second lens plate 19 may be several millimetres. Thus, for example, the focal length of the lens elements 22*a*, 22*b*, 22*c* of the first lens plate 18 may be between 3 mm and 10 mm and the focal length 26 of the lens elements 23*a*, 23*b*, 23*c* of the second lens plate 19 may be between 0.5 mm and 2.9 mm.

With reference to the embodiment of FIG. 3 it is now to be explained schematically that an individual lens element, for example the lens element 23*e*, may not necessarily be formed from a sphere but also from a paraboloid of revolution. The cap region 72 of each rotationally parabolic lens element 23*e* may, however, be described approximately by a circle 73. This circle 73 may have a radius R.

The light beams (see FIG. 33) entering inside this cap region 22 are focused in the cap region—approximately—at a common focal point 61.

In reality, as a result of the deviation of the cap shape 72 and/or the contour of the paraboloid of revolution from a sphere, the situation may occur that a precise focal point 61 is not produced but rather a focal point region. Moreover, such a focal point region may, however, have an average focal length fM. This description takes into account that when considering all beams passing through the cap region 72 and/or through the paraboloid of revolution of this lens element 23*e*, an average focal length fM may be calculated or determined.

Figure 34:
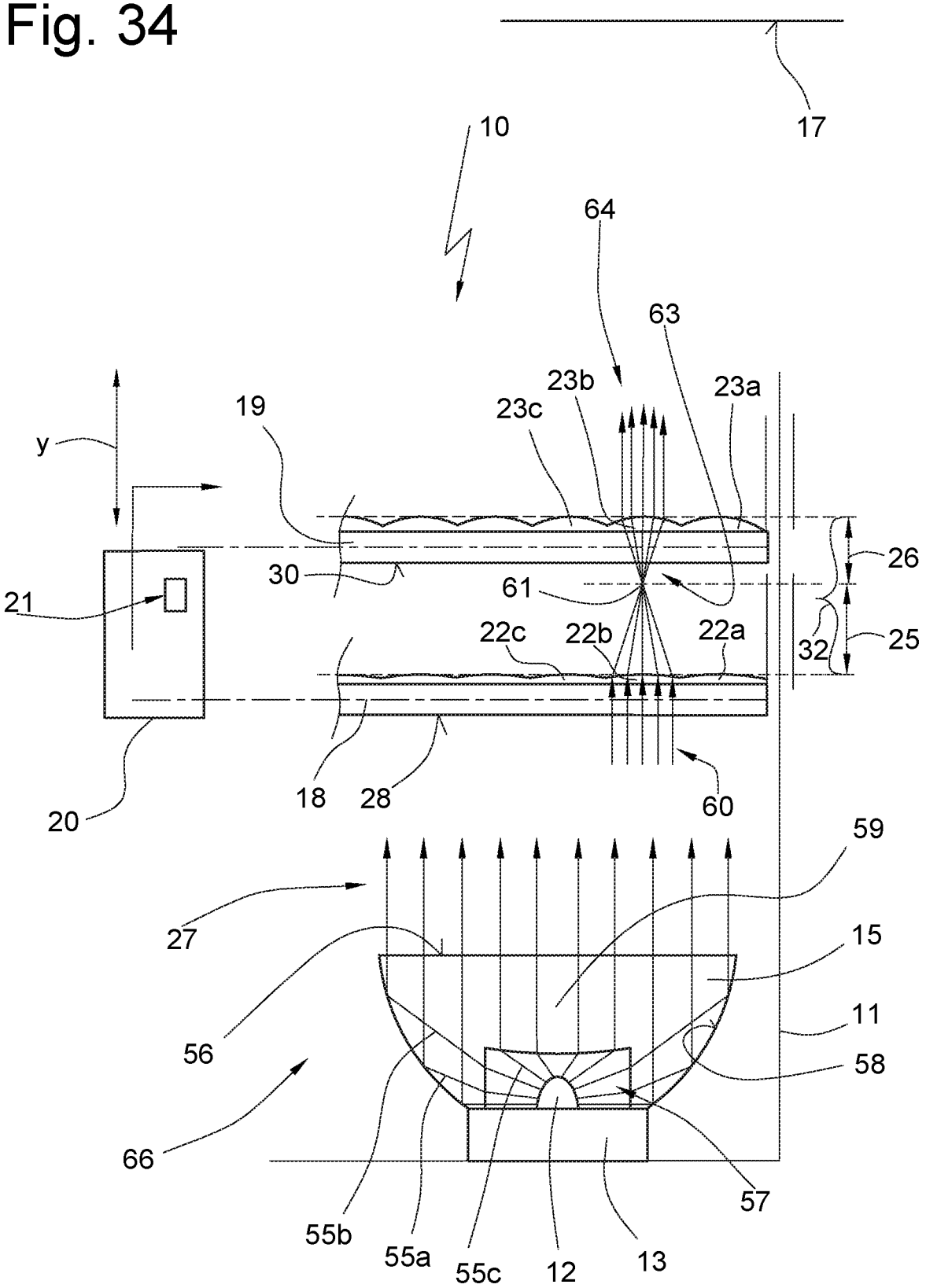

With reference to the embodiment of FIG. 34, it may be established that the focal length 25 of the lens elements 22*a*, 22*b*, 22*c* of the first lens plate 18 may also be an average focal length 25. In further embodiments, which are not shown in the drawings and that are encompassed by the invention, it may be provided that the average focal length 25 of the lens elements 22*a*, 22*b*, 22*c* of the first lens plate 18 is greater than the average focal length 26 of the lens elements 23*a*, 23*b*, 23*c* of the second lens plate 19.

However, in further embodiments, not shown in the figures, it is provided that the average focal length 25 of the lens elements 22*a*, 22*b*, 22*c* of the first lens plate 18 is smaller than the average focal length 26 of the lens elements 23*a*, 23*b*, 23*c* of the second lens plate 19.

FIG. 34 finally shows—with reference to and coinciding with the embodiment of FIG. 32—a further embodiment in which all of the lens elements 22*a*, 22*b*, 22*c*, 23*a*, 23*b*, 23*c* on the two lens plates 18, 19 are each on the side of that lens plate 18, 19 that is remote from the collimator optical unit 15.

The invention claimed is:

1. A light fixture for illuminating building surfaces or partial surfaces of a building, the light fixture comprising:

a housing, a light source on the housing, a focusing optical unit on the housing and separate from the light source for focusing and projecting light emitted by the light source in a direction, a first lens plate in the light path spaced a first distance downstream in the direction of the focusing optical unit, the first lens plate having an array of first lens elements arranged thereon, a second lens plate receiving light from the first lens plate and spaced a second distance downstream in the direction from the first lens plate, the second lens plate having an array of second lens elements arranged thereon, wherein each of at least some of the first lens elements aligned in the direction with a respective second lens element, each first lens element receiving parallel light from the optical unit and focusing all of the received light on the respective second lens element, and an adjusting device for varying at least the second distance such that the light fixture provides different light distributions in different relative spacings of the lens plates, wherein at least one second distance is provided wherein the light emanating from the first lens element is to focus in a focal point between the first lens plate and the second lens plate.

2. The light fixture according to claim 1, wherein the adjusting device for altering the spacing has a motorized drive.

3. The light fixture according to claim 1, wherein the adjusting device is provided with a positioning device that when carrying out an alteration to the spacing between the first and second lens plates ensures that a relative rotational position between the first and second lens plates is maintained.

4. The light fixture according to claim 1, wherein the different light distributions have different radiation angles of the light fixture.

5. The light fixture according to claim 1, wherein the light fixture provides different radiation angles at different first and second distances.

6. The light fixture according to claim 1, wherein the first and second distances are continuously variable.

7. The light fixture according to claim 1, wherein one of the first and second lens plates is fixed relative to the housing and the other lens plate is displaceable by the adjusting device relative to the housing.

8. The light fixture according to claim 1, wherein the lens elements have facets on at least one of the lens plates.

9. The light fixture according to claim 1, wherein the lens elements have lenticular lenses on at least one of the lens plates.

10. The light fixture defined in claim 1, wherein the focusing optical unit emits light as bundles of parallel light rays that are received by the first and second lens elements on the first and second lens plates.

11. The light fixture according to claim 1, wherein the light of the focusing optical unit emanates as a parallel bundle of light to a plurality of first lens elements.

12. The light fixture according to claim 1, wherein one side of each of the lens plates is flat.

13. A light fixture for illuminating building surfaces or partial surfaces of a building, the light fixture comprising:

a housing, a light source on the housing, a focusing optical unit on the housing and separate from the light source for focusing and projecting light emitted by the light source in a direction, a first lens plate in the light path spaced a first distance downstream in the direction of the focusing optical unit, a second lens plate receiving light from the first lens plate and spaced a second distance downstream in the direction from the first lens plate, respective arrays of first and second lens elements on the lens plates with each of at least some of the first lens elements aligned in the direction with a respective second lens element, each first lens element receiving parallel light from the optical unit and focusing all of the received light on the respective second lens element, and an adjusting device for varying at least the second distance such that the light fixture provides different light distributions in different relative spacings of the lens plates, the adjusting device having a manually actuatable adjusting element on the housing for altering the spacing, wherein at least one second distance is provided wherein the light emanating from the first lens element is to focus in a focal point between the first lens plate and the second lens plate.

14. A light fixture for illuminating building surfaces or partial surfaces of a building, the light fixture comprising:

a housing, a light source on the housing, a focusing optical unit on the housing and separate from the light source for focusing and projecting light emitted by the light source in a direction, a first lens plate in the light path on the housing and spaced a first distance downstream in the direction from the optical unit, a second lens plate receiving light from the first lens plate and spaced a second distance downstream in the direction from the first lens plate, respective arrays of first and second lens elements on the lens plates and each having on a face of the respective lens plate a plurality of facets, some of or all of the facets having an arched structure that is spherical or approximates a sphere, each of at least some of the first lens elements being aligned in the direction with a respective second lens element to receive parallel light from the optical unit and focus all of the received light in the direction on the respective second lens element, and an adjusting device for varying at least the second distance between the first and second lens plates such that the light fixture provides different light distributions in different relative spacings of the lens plates.

15. The light fixture according to claim 14, wherein the adjusting device maintains alignment when altering the second distance between the lens plates.

* * * * *